US006116714A

United States Patent [19]

Imanaka et al.

[11] Patent Number: 6,116,714

[45] **Date of Patent: *Sep. 12, 2000**

[54] PRINTING HEAD, PRINTING METHOD AND APPARATUS USING SAME, AND APPARATUS AND METHOD FOR CORRECTING SAID PRINTING HEAD

[75] Inventors: Yoshiyuki Imanaka, Yokohama; Masaki Inaba, Kawasaki; Masami Ikeda; Yutaka Koizumi, both of Yokohama; Tsuyoshi Orikasa, Musashimurayama; Tatsuo Furukawa, Isehara; Toshio Kashino, Chigasaki; Hideaki Kishida, Kawasaki; Seiichiro Karita, Yokohama; Shuji Koyama, Kawasaki; Haruhiko Terai; Kimiyuki Hayasaki, both of Yokohama; Shuichi Katao, Atsugi; Akira Goto, Yokohama; Kouichi Omata, Kawasaki; Hiroyuki Maru, Atsugi; Masaaki Izumida, Kawasaki; Yuji Kamiyama, Fujisawa; Takayuki Ono, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/397,352

[22] Filed: Mar. 2, 1995

[30] Foreign Application Priority Data

| | | | |
|---|---|---|---|
| Mar. 4, 1994 | [JP] | Japan | 6-034558 |
| Mar. 7, 1994 | [JP] | Japan | 6-035607 |
| Mar. 23, 1994 | [JP] | Japan | 6-051711 |

[51] Int. Cl.[7] ..... B41J 29/393

[52] U.S. Cl. ..... 347/19

[58] Field of Search ..... 347/19, 17, 13, 347/60, 185, 186

[56] References Cited

U.S. PATENT DOCUMENTS

| | | | |
|---|---|---|---|
| 3,700,852 | 10/1972 | Ruggiero | 347/211 |
| 4,074,320 | 2/1978 | Kapes, Jr. | 358/302 X |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |

(List continued on next page.)

FOREIGN PATENT DOCUMENTS

| | | |
|---|---|---|
| 0042055 | 12/1981 | European Pat. Off. . |
| 0183680 | 6/1986 | European Pat. Off. . |
| 0260574 | 3/1988 | European Pat. Off. . |
| 0405574 | 1/1991 | European Pat. Off. . |
| 0419178 | 3/1991 | European Pat. Off. . |

(List continued on next page.)

OTHER PUBLICATIONS

Tsutsumi, Y. et al., "Desktop Publishing System", Toshiba Publication, vol. 44, No. 1 (1989), cover, pp. 45–48 and 80.

*Primary Examiner*—N. Le
*Assistant Examiner*—Judy Nguyen
*Attorney, Agent, or Firm*—Fitzpatrick, Cella, Harper & Scinto

[57] ABSTRACT

A printing head has a plurality of heater boards, each of which includes a shift register to which printing data and selection data for selecting preheating pulse signals are applied as inputs, a latch circuit for latching the printing data, a selection-data latch circuit for latching the selection data, a selection circuit for selecting any one of a plurality of preheating pulse signals inputted in accordance with the latched selection data, and a plurality of heating resistors driven by the printing data or preheating pulse signals. Correction data, obtained by a head correcting apparatus, for performing printing at an average density by correcting the characteristics of each heater board is stored in a memory of the printing head. A printing apparatus decides the selection data in accordance with the correction data and sets the selection data in the selection-data latch circuit.

41 Claims, 27 Drawing Sheets

U.S. PATENT DOCUMENTS

| | | | |
|---|---|---|---|
| 4,563,691 | 1/1986 | Noguchi et al. | 347/190 |
| 4,595,935 | 6/1986 | Brooks et al. | 347/171 |
| 4,596,995 | 6/1986 | Yamakawa et al. | 347/237 |
| 4,608,577 | 8/1986 | Hori | 347/66 |
| 4,689,694 | 8/1987 | Yoshida | 347/237 X |
| 4,723,129 | 2/1988 | Endo et al. | 347/56 |
| 4,740,796 | 4/1988 | Endo et al. | 347/56 |
| 4,829,324 | 5/1989 | Drake et al. | 347/63 |
| 4,835,549 | 5/1989 | Samejima et al. | 347/237 |
| 4,908,635 | 3/1990 | Iwasawaa et al. | 347/14 |
| 4,918,462 | 4/1990 | Tomita et al. | 347/237 |
| 4,982,199 | 1/1991 | Dunn | 347/60 X |
| 5,016,023 | 5/1991 | Chan et al. | 347/42 |
| 5,036,337 | 7/1991 | Rezanka | 347/14 |
| 5,049,898 | 9/1991 | Arthur et al. | 347/19 |
| 5,057,854 | 10/1991 | Pond et al. | 347/42 |
| 5,065,170 | 11/1991 | Rezanka et al. | 347/42 |
| 5,068,674 | 11/1991 | Sato et al. | 347/62 |
| 5,098,503 | 3/1992 | Drake | 156/299 |
| 5,109,234 | 4/1992 | Otis, Jr. et al. . | |
| 5,157,411 | 10/1992 | Takekoshi, et al. . | |
| 5,164,747 | 11/1992 | Osada et al. | 347/19 |
| 5,175,565 | 12/1992 | Ishinaga et al. | 347/67 |
| 5,235,351 | 8/1993 | Koizumi | 347/14 |
| 5,281,980 | 1/1994 | Kishida et al. | 347/13 |
| 5,285,220 | 2/1994 | Suzuki et al. | 347/14 |
| 5,289,210 | 2/1994 | Takayanagi | 347/14 |
| 5,305,024 | 4/1994 | Moriguchi et al. | 347/11 |
| 5,353,051 | 10/1994 | Katayama, et al. | 347/13 |
| 5,361,087 | 11/1994 | Tajima et al. | 347/44 |
| 5,473,351 | 12/1995 | Helterline et al. | 347/19 |
| 5,475,405 | 12/1995 | Widder et al. | 347/14 |
| 5,504,507 | 4/1996 | Watrobski et al. | 347/19 |
| 5,596,353 | 1/1997 | Takada et al. | 347/19 |
| 5,861,895 | 1/1999 | Tajika, et al. | 347/14 |
| 5,894,314 | 4/1999 | Tajika, et al. | 347/14 |

FOREIGN PATENT DOCUMENTS

| | | |
|---|---|---|
| 0421806 | 4/1991 | European Pat. Off. . |
| 0440490 | 8/1991 | European Pat. Off. . |
| 0445916 | 9/1991 | European Pat. Off. . |
| 0453714A | 10/1991 | European Pat. Off. . |
| 0475638 | 3/1992 | European Pat. Off. . |
| 0511602 | 11/1992 | European Pat. Off. . |
| 0527610 | 2/1993 | European Pat. Off. . |
| 532248 | 3/1993 | European Pat. Off. . |
| 0605216 | 7/1994 | European Pat. Off. . |
| 54-56847 | 5/1979 | Japan . |
| 55-132253 | 10/1980 | Japan . |
| 59-123670 | 7/1984 | Japan . |
| 59-138461 | 8/1984 | Japan . |
| 60-71260 | 4/1985 | Japan . |
| 2-2009 | 1/1990 | Japan . |
| 3-227633 | 10/1991 | Japan . |
| 3-227635 | 10/1991 | Japan . |
| 3-227641 | 10/1991 | Japan . |
| 3-227663 | 10/1991 | Japan . |
| 3-227669 | 10/1991 | Japan . |
| 4-110169 | 4/1992 | Japan . |
| 4-133741 | 5/1992 | Japan . |
| 4-229278 | 8/1992 | Japan . |
| 4-232749 | 8/1992 | Japan . |
| 4-332657 | 11/1992 | Japan . |
| 5-24192 | 2/1993 | Japan . |
| 5-31905 | 2/1993 | Japan . |
| 5-42682 | 2/1993 | Japan . |
| 5-193127 | 8/1993 | Japan . |
| 2169856 | 7/1986 | United Kingdom . |
| 2220892 | 1/1990 | United Kingdom . |
| 2 242 046 | 9/1991 | United Kingdom . |
| 2243265 | 10/1991 | United Kingdom . |
| WO 91/14577 | 10/1991 | WIPO . |

FIG. 20

| SELECT B DATA | SELECT A DATA | PREHEATING PULSE SELECTED |
|---|---|---|
| 0 | 0 | PHEAT 1 |
| 0 | 1 | PHEAT 2 |
| 1 | 0 | PHEAT 3 |
| 1 | 1 | PHEAT 4 |

PRINTING HEAD, PRINTING METHOD AND APPARATUS USING SAME, AND APPARATUS AND METHOD FOR CORRECTING SAID PRINTING HEAD

BACKGROUND OF THE INVENTION

1. Field of the Invention

This invention relates to an elongated printing head having a plurality of printing elements, a printing method and apparatus using this printing head, and an apparatus and method for correcting the printing head.

2. Description of the Related Art

A printing apparatus such as a printer, copying machine or facsimile machine prints an image comprising a dot pattern on a printing medium such as paper, a thin plastic sheet or cloth based upon image information. Among these printing apparatus, those which are the focus of attention because of their low cost make use of printing heads that rely upon the ink jetting method, the thermal printing method or LED method, etc., in which a plurality of printing elements corresponding to dots are arrayed on a substrate.

In a printing head in which printing elements such as heating resistors or nozzles are arrayed to correspond to a certain printing width, the printing elements can be formed through a process similar to that used to manufacture semiconductors. Accordingly, a transition is now being made from a configuration in which the printing head and driving integrated circuitry are arranged separately of each other to a configuration in which the driving integrated circuitry is formed on the board of the head on which the printing elements are arrayed. As a result, complications in driving the printing head be avoided and the printing apparatus can be reduced in size and cost.

Among these types of printing methods, the ink-jet printing method is particularly advantageous. According to this method, thermal energy is made to act upon ink and the ink is jetted by utilizing the pressure produced by thermal expansion. This method is advantageous in that the response to a printing signal is good and it is easy to group the discharge ports together at a high density. There are greater expectations for this method in comparison with the other methods.

However, when the printing head is manufactured through a process used to manufacture semiconductors, as mentioned-above, numerous printing elements to be made to correspond to the printing width are arrayed over the entire area of a board, and therefore it is very difficult to manufacture all of the printing elements without any defects. As a consequence, the manufacturing yield of the printing head is poor and this is accompanied by higher manufacturing cost. It is very difficult to achieve such a printing head in practice.

Accordingly, methods of manufacturing an elongated printing head have been disclosed in the specifications of Japanese Patent Application Laid-Open (KOKAI) Nos. 55-132253, 2-2009, 4-229278, 4-232749 and 5-24192 and in the specification of U.S. Pat. No. 5,016,023. According to these methods, a large number high-yield printing head boards, each having an array of a comparatively small number of printing elements, e.g., 32, 48, 64 or 128 printing elements, are placed upon a single heater board in conformity with the density of the array of printing elements, thereby providing an elongated printing head whose length corresponds to the necessary printing width.

It has recently become possible on the basis of this technique to simply manufacture a full-line printing head by arraying a comparatively small number (e.g., 64 or 128) of printing elements on a substrate and bonding these substrate (referred to as "heater board" or "element substrate") on which printing elements are arrayed, in a row on a base plate which serves as a base, in precise fashion in a length corresponding to the necessary printing width.

Though it has become easy to manufacture a full-line printing head, certain performance-related problems remain with regard to a printing head manufactured by the foregoing manufacturing method. For example, a decline in printing quality, such as irregular distribution, cannot be avoided. The cause is a variance in performance from one heater board to another heater board in the row of such heater boards, a variance in the characteristics of neighboring printing elements between heater boards and heat retained in each driving block of the printing elements at the time of printing.

In the case of an ink-jet printing head, not only a variance in the neighboring printing elements between the arrayed heater boards but also a decline in ink fluidity owing to the gaps between heater boards results in lower yield in the final stage of the head production process. For this reason, the state of the art is such that these printing heads are not readily available on the market in large quantities regardless of the fact these printing heads exhibit highly satisfactory capabilities.

FIG. 12 is a block diagram illustrating an example of the circuit construction of a heater board according to the prior art.

As shown in FIG. 12, numeral 900 denotes an element substrate (heater board) having heating elements (heating resistors) 901; power transistors 902 for controlling flow of current to the heating elements 901; a latch circuit 903 for latching printing data in sync with a latch clock (on pad 907); a shift register 904, the inputs to which are serial data (on pad 906) and a serial clock (on pad 905) synchronized to the serial data, for latching one line of data; a resistance sensor 914 manufactured by the same forming process as the forming process of the heating elements 901, for monitoring the resistance values of the heating elements 901; a temperature sensor 915 used to monitor the temperature of the heater board 900; and input/output terminals 905~913. Specifically, numeral 908 denotes a driving pulse input (heating pulse) terminal for externally controlling the ON time of the power transistors 902, namely the time during which a current is flowed through the heating elements (resistors) 901 to drive them. Numeral 909 denotes a driving power-supply (5 V) terminal for powering logic circuitry. Numeral 910 designates a ground terminal; 911 an input terminal for powering the heating elements 901; 912 terminals for driving and monitoring the resistance sensor 914; and 913 terminals for driving and monitoring the temperature sensor 915.

In the arrangement described above, serially entered printing data is stored in the shift register 904 and latched in the latch circuit 903 by a latch signal. In response to a heating pulse which enters from the terminal 908 under these conditions, the transistors 902 are turned ON in accordance with the printing data to flow a current through the corresponding heating elements 901, thereby heating ink in the respective ink passageways so that the ink is discharged from the ends of the nozzles in the form of droplets.

Consider the energy needed to form bubbles in the ink at the heating elements 901. If the thermal radiation conditions are constant, the energy will be expressed by the product of the necessary energy introduced per unit area of the heating element 901 and the surface area of the heating element 901. This means that the voltage across the heating element 901, the current flowing through it and the duration (pulse width) of current flow should be set to values according to which the necessary energy will be obtained. The voltage impressed upon the heating element 901 can be held substantially constant by supplying voltage from the power supply of the printing apparatus per se. As for the current flowed through the heating elements 901, the resistance values of the heating elements 901 differ depending upon the lot or board owing to a variance in the film thickness of the heating elements 901 brought about in the process for manufacturing the heater board 900. Accordingly, in a case where the applied pulse width is constant and the resistance value of a heating element 901 is greater than what the design calls for, the value of the current flowing through this heating element 901 declines and the amount of energy introduced to the heating element 901 becomes inadequate. As a result, the ink cannot be made to form bubbles properly. Conversely, if the resistance of a heating element 901 is too small, the current value will become greater than the design value even if the same voltage is applied. In this case, excessive energy is produced by the heating element 901 and there is the danger that the heating element 901 will burn out or have its service life shortened. A method of dealing with this is to constantly monitor the resistance values of the heating elements 901 by the resistance sensor 914 or the temperature of the heater board 900 by the temperature sensor 915, change the power-supply voltage or heating pulse width based upon the monitored values and arrange it so that a substantially constant energy is applied to the heating elements 901.

Next, consider the amount of ink discharged in the jetted droplets. The amount of discharged ink is related mainly to the volume of the ink bubbles. Since the volume of an ink bubble varies depending upon the temperature of the heating element 901 and the temperature of the surroundings, a pulse (a preheating pulse) whose energy is not high enough to jet ink is applied before the heating pulse that causes the jetting of the ink, then the temperature of the heating element 901 and of its surroundings is adjusted by changing the pulse width and output timing of the preheating pulse to thereby discharge ink droplets in a constant amount. This makes it possible to maintain printing quality.

Correction of variance in the resistance values of the heating elements 901 and control of the substrate temperature are carried out by feeding back signals from the respective sensors 914, 915 and outputting a heating signal whose heating pulse width, preheating pulse width and preheating/heating pulse timings have been altered based upon the feedback. However, in addition to the foregoing problems, there is a structural variance in the area of the orifice openings and a variance in the film thickness of a protective film provided on the heating elements 901. As a result, there is a variance in the amount of ink discharge produced by each nozzle. This leads to irregular density and streaks at the time of printing and makes it necessary to control the amount of ink discharge on a per-nozzle basis or in units of several nozzles. Furthermore, in a case where a plurality of the heater boards of FIG. 12 are placed in a row to construct an ink-jet head having a multiplicity of nozzles, the resistance values of the heating elements 901 differ from one heater board to the next. Consequently, the heating pulses for discharging ink must be changed for each heater board to bring the applied energies into conformity. In other words, in the case of a printing head constituted by a plurality of heater boards, irregular density is caused not only by the variance in orifice area but also by a conspicuous difference in density from one board to another. This means that correcting the amount of discharge on a per-nozzle basis within a heater board becomes more important in a printing head having a plurality of heater boards than in a printing head having a single heater board.

SUMMARY OF THE INVENTION

Accordingly, an object of the present invention is to provide a printing head, as well as a printing method and apparatus using the same, in which the printing head is simple to manufacture, exhibits a high yield and does not result in reduced printing quality.

Another object of the present invention is to provide a printing head in which printing can be performed while correcting for a variance in the printing elements without greatly increasing the size of the head circuit board, as well as a printing method and apparatus using this printing head and a printing-head correction method and apparatus in which correction data can be determined.

Another object of the present invention is to provide a printing head, as well as a printing method and apparatus using the same, in which driving current can be applied in a variety of ways while reducing processing on the side of the printing apparatus.

Another object of the present invention is to provide a printing head, as well as a printing method and apparatus using the same, in which printing characteristics arising from a variance in the resistance values of resistive elements (e.g. heat resistors or thermal elements) can be adjusted by heating pulses.

A further object of the present invention is to provide a printing head, as well as a printing method and apparatus using the same, in which printing can be performed while correcting for a variance in individual printing elements of the printing head.

A further object of the present invention is to provide a printing method and apparatus in which printing can be performed while correcting for variance in the printing characteristics of the printing head by preheating pulses.

Yet another object of the present invention is to provide a method and apparatus for correcting a printing head, as well as a printing method and apparatus, in which even if the printing head is constituted by a plurality of element substrates, a variance in the heat resistors of all of the element substrates can be adjusted in a simple manner to allow printing.

Still another object of the present invention is to provide is to provide a printing head in which the burden on control circuitry is reduced and the printing head is driven in a highly precise manner to perform printing.

Still another object of the present invention is to provide is to provide a printing head in which processing on the side of the printing apparatus is reduced and pulse width is changed to apply driving current.

A further object of the present invention is to provide a printing method and apparatus in which printing is performed while correcting for variance of individual printing elements.

Another object of the present invention is to provide a printing method and apparatus in which printing is performed while using heating pulses to adjust printing characteristics arising from a variance in the resistance values of heat resistors.

Another object of the present invention is to provide a printing head, printing method and printing apparatus in which printing is performed while altering the pulse width of heating pulses automatically upon detecting a variance in the printing characteristics of the printing head.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principle of the invention.

FIG. 20 is a diagram showing the relationship between select data A, B of FIG. 19 and preheating pulses actually selected;

DETAILED DESCRIPTION OF THE PREFERRED EMBODIMENT

Preferred embodiments of the present invention will now be described in detail with reference to the accompanying drawings.

Figure 1:
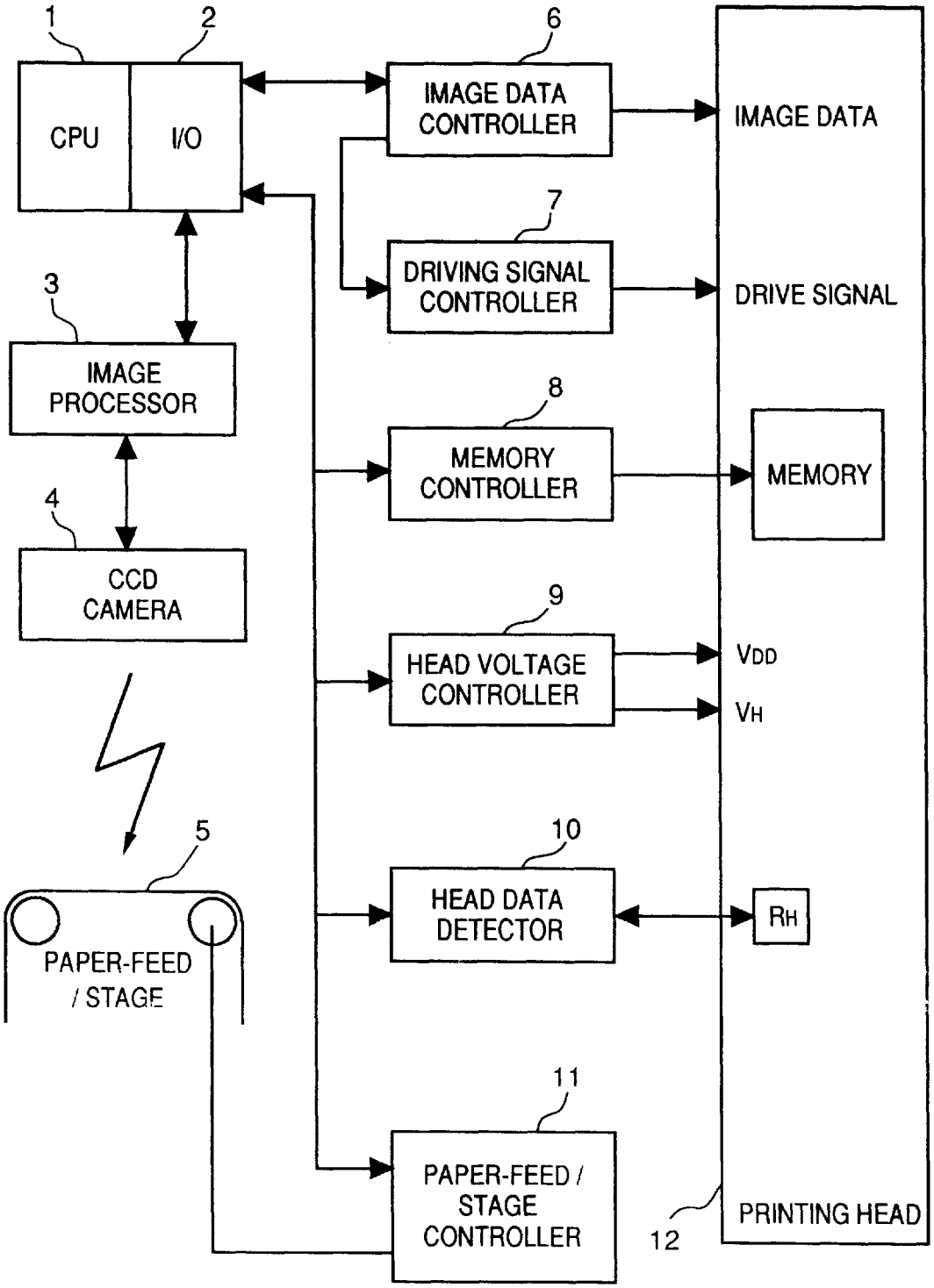
FIG. 1 is a block diagram illustrating the construction of an apparatus for correcting a printing head in a first embodiment of the present invention.

FIG. 1 is a block diagram showing the construction of a head correcting apparatus for determining correction data of a printing head 12 according to a first embodiment of the present invention.

In FIG. 1, a CPU 1, which controls the overall correcting apparatus, manages various controllers, described later. An I/O interface 2 interfaces the CPU 1 with the various components of the apparatus. An image processor 3 uses a CCD camera 4 to read the printing dot pattern on a recording medium placed upon a paper feeding stage 5 and obtains pixels conforming to printed dot diameter and density. When the dot data corresponding to all printing elements (nozzles) of the printing head 12 is sent from the image processor 3 to the CPU 1, the latter operates upon the dot data, sends density correction data to a driving signal controller 7 in conformity with a drive signal for driving the printing head 12 and causes a memory controller 8 to develop the density correction data in a memory 13.

An image data controller 6 outputs a dot pattern to be printed to the printing head 12. The controller 6 transmits a density correction drive signal while sending a synchronizing signal to the drive signal controller 7 not only at the time of ordinary printing but also when the density correction data has been determined. The CPU 1 manages a head voltage controller 9 which controls the driving voltage of the printing head 12 and manages a paper-feed/stage controller 11 for controlling the operation of the paper feeding stage 5, thereby setting a proper drive voltage and controlling the movement of the stage 5 and paper feed. Furthermore, a head data detector 10 is an important portion which, for the purpose of correcting density, feeds back the characteristics of each element substrate (heater board 1000, shown in FIGS. 4 and 8) of the printing head 12.

In the printing head 12 which, by way of example, is composed of a row of a plurality heater boards 1000 on which 64 or 128 printing elements have been formed, it is not known from which portions of a silicon wafer or the like the heater boards 1000 (1000-1~1000-m) have been cut. Accordingly, there are cases in which the characteristics differ from one heater board to another.

In such case, a rank detecting resistor element RH (resistor monitor 914 in FIG. 8) constituted by a sheet resistance value identical with board of the printing elements is provided in each heater board 1000 in order that all printing heads can perform printing at an identical density. There are also cases in which a semiconductor element 915 (see FIG. 12) capable of monitoring a change in temperature is provided for each heater board 1000. The head data detector 10 monitors these elements. When the head data detector 10 sends data obtained by monitoring these elements to the CPU 1, the CPU 1 generates correction data, which is for correcting the data that drives each of the heater boards 1000, in such a manner that each heater board 1000 can print at an average density.

When the above-mentioned correction data is reflected in each controller of the correcting apparatus of this embodiment, the printing operation by the printing head 12 is executed under these conditions. In the correcting apparatus, the results of printing are again subjected to image processing by the CCD camera 4 and image processor 3, and the memory controller 8 writes the final correction data in a memory 13 (an EEPROM or the like) at a stage at which the predetermined rating of the printing head 12 is satisfied.

Figure 2:
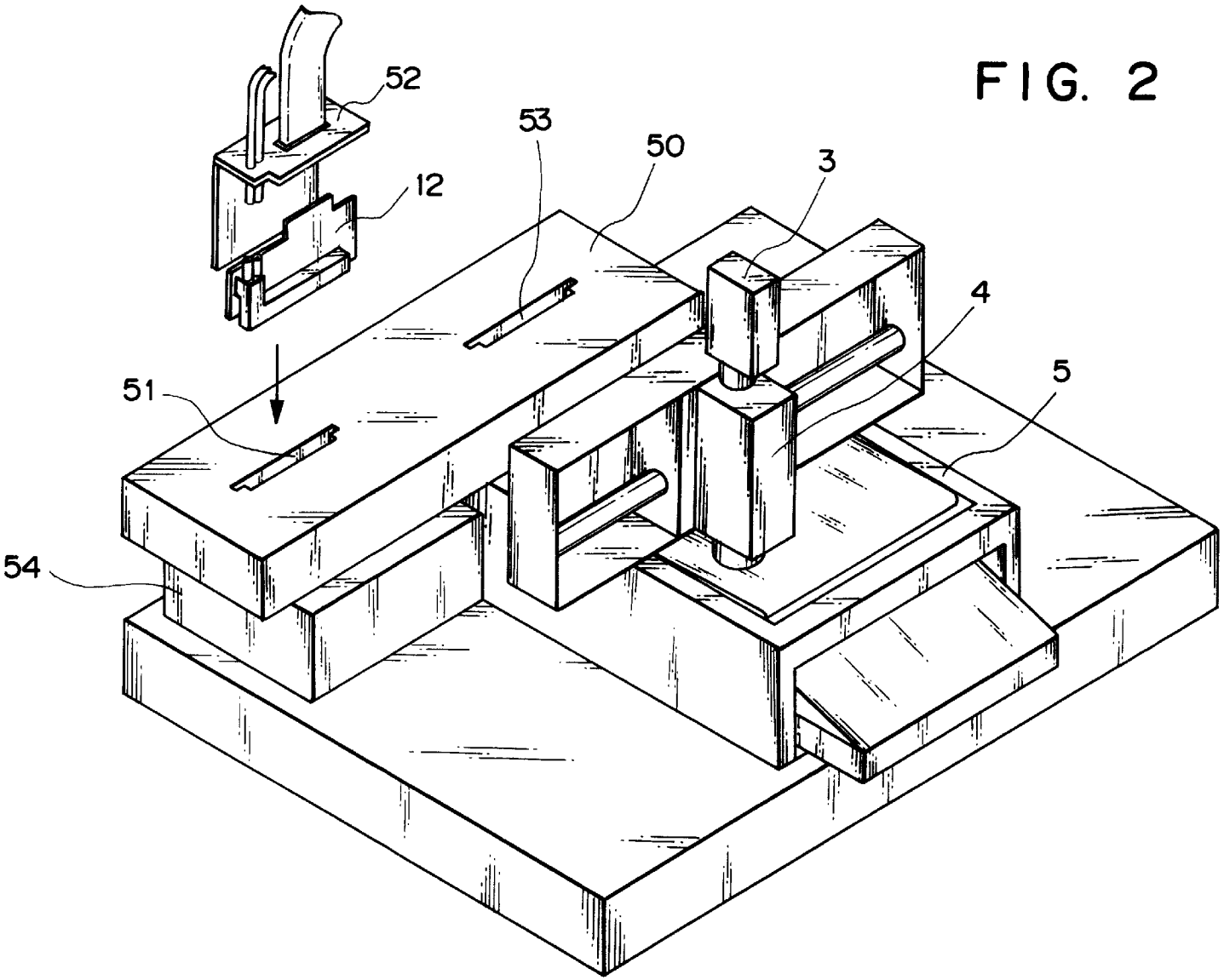
FIG. 2 is a perspective view showing the construction of the apparatus for correcting the printing head in the first embodiment.
Figure 3:
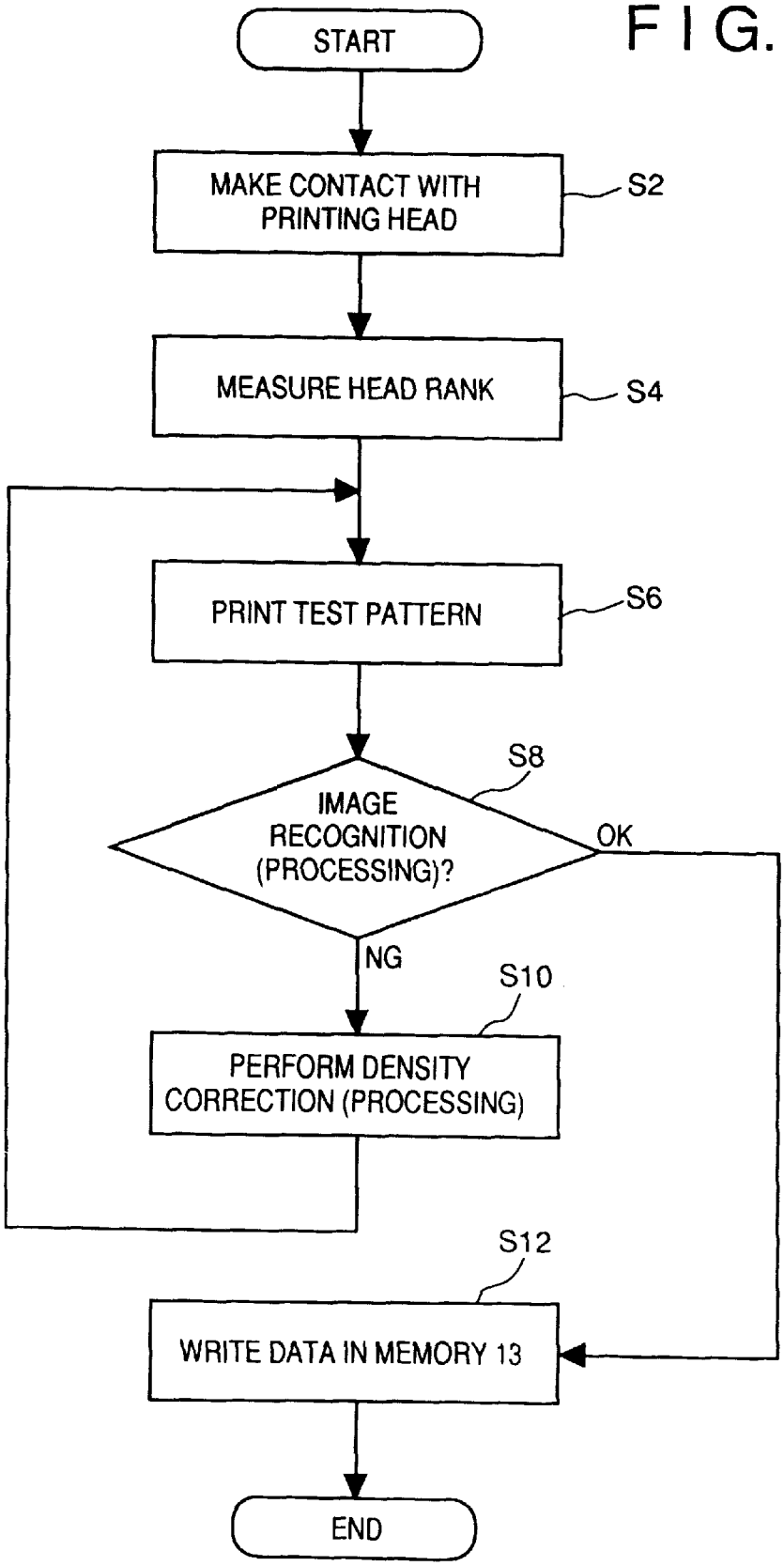
FIG. 3 is a flowchart showing the operation of the apparatus for correcting the printing head in the first embodiment.

FIG. 2 is a perspective view showing the construction the printing-head correcting apparatus of the first embodiment, and FIG. 3 is a flowchart illustrating the operation of the apparatus.

With the printing head 12 inserted into a slot 51 or 53 of a securing table 50, the table 50 is moved in such a manner that the printing head 12 can perform printing at a normal position. Under these conditions, the printing head 12 is brought into electrical contact with the components shown in FIG. 1, and an ink supply device 52 is connected to the printing head 12 (step S2). Next, in order to measure the rank of the printing head 12, a signal from the sheet resistance monitor 914 of each heater board 1000 is applied to the apparatus, which proceeds to monitor these signals (step S4). In the case of an elongated (full-line) printing head unit, the sheet resistance value of each block (of each heater board in a case where the unit is constituted by an array of a plurality of heater boards) is monitored, driving power is decided separately for each heater board and a test pattern is printed (step S6). As preprocessing for printing the test pattern, preliminary printing (aging) is carried out until the operation of the printing head 12 stabilizes to enable stable printing by the printing head 12. Aging is performed on an aging tray juxtaposed on a head recovery processor 54, and recovery processing (ink suction, cleaning of orifice surfaces, etc.) is executed in such a manner that the test pattern can be printed correctly on a paper. When a test pattern is thus printed, the printed paper is moved to the position of the CCD camera 4 and image processor 3, where the result of printing is subjected to image processing by these components and compared with parameters for printing evaluation. Processing is executed with regard to the following items in relation to a variance in printing element density, which is a parameter that can be improved:

(In a case where the total number of printing elements on each heater board is "n")

(1) The average dot area (dot diameter) of each printing element and elements on either side thereof (for a total of three elements) is calculated.

In particular, the following averages are calculated with regard to the first and n-th elements:

in case of the first element→the average dot area (dot diameter) of the n-th on the neighboring heater board, 1st and 2nd elements on the current board;

in case of the n-th element→the average dot area (dot diameter) of the (n−1) th, n-th on the current board and 1st elements on the neighboring heater board.

(2) The following two values are found with regard to the average dot area of each printing element obtained in (1) above:

uneven density f(1)=[MAX of average dot area of each heater board]−[MIN of average dot area of each heater board]

uneven density f(2)=MAX of change in average dot area of each heater board of successive heater boards.

Figure 8:
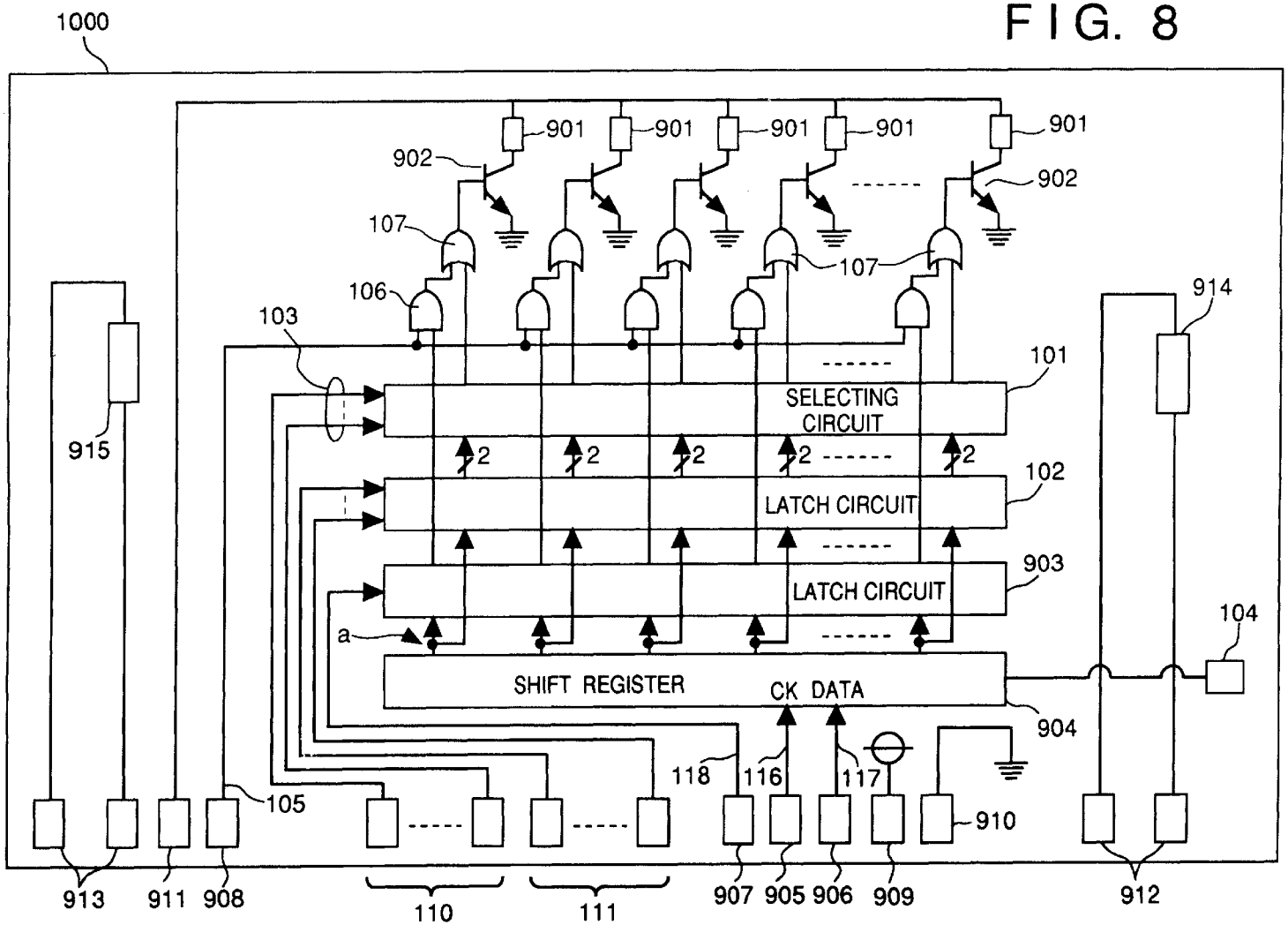
FIG. 8 is a diagram showing an example of circuitry on the element substrate (heater board) of a printing head in a second embodiment of the present invention.

These values are decided to determine the manner in which each printing element should be corrected. For example, in a case where the driving power of each printing element of the printing head 12 is decided by pulse width, driving pulse-width data applied to an integrated circuit for driving the printing head 12 is selected. As will be described later, in a case where a pulse-width selecting circuit (101: FIG. 8) of the driving integrated circuit makes a selection from several pulse widths, the MAX, MIN of the pulse width selected on the basis of the values decided in (1), (2) above are decided and a pulse width between these values is set based upon the resolution allowed. The pulse width is set so as to correct the printing density of each element in conformity with the image processing data, and the pulse width is made to correspond to each printing element, whereby it is possible to average the printing densities of the printing head unit 12. The foregoing is repeated until the above-described processing is finished. When this occurs, the resulting data is stored in the memory 13. This processing is carried out at steps S8~S12 in FIG. 3.

Figure 4:
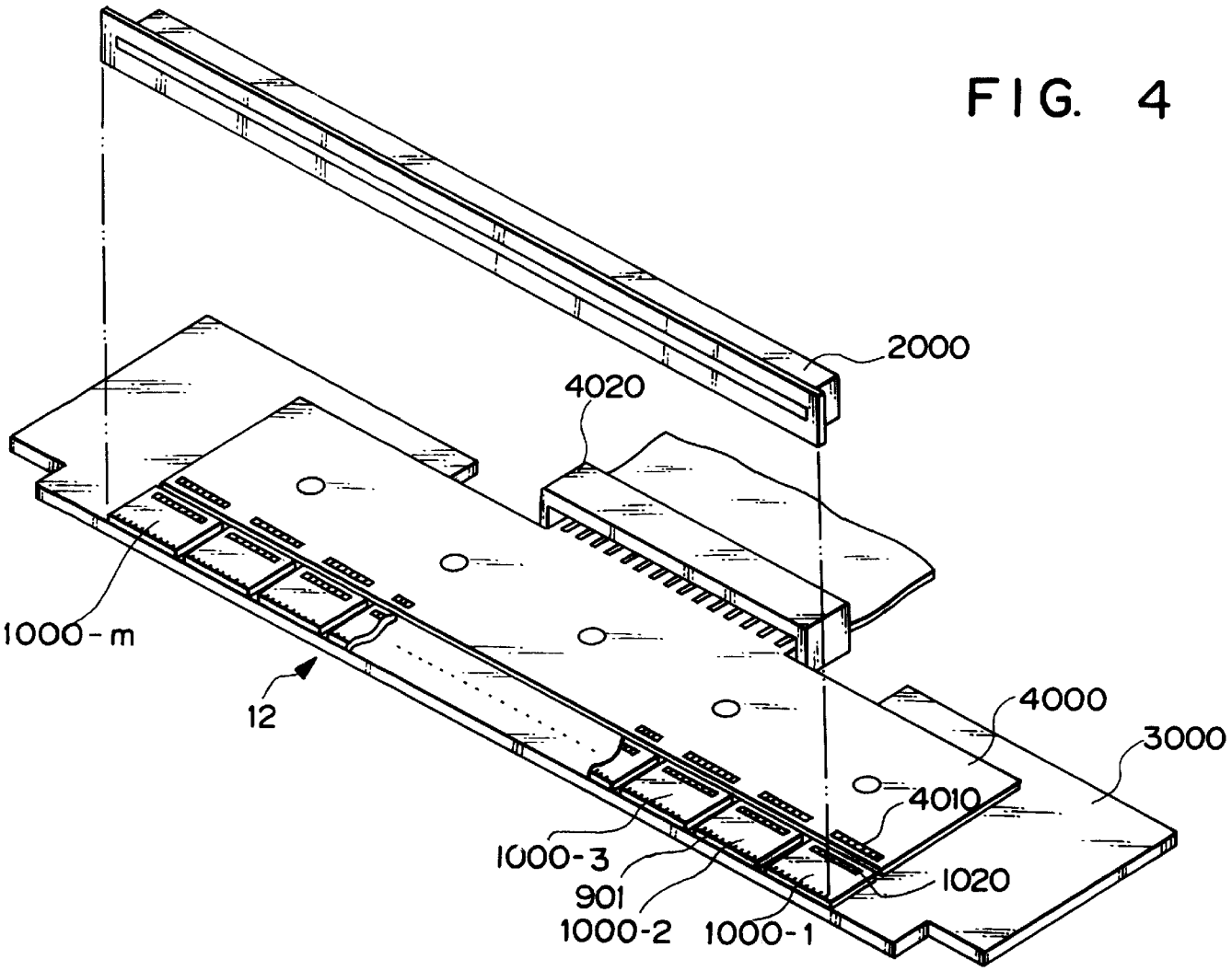
FIG. 4 is an exploded perspective view for describing the construction of the printing head of this embodiment.

FIG. 4 is an exploded perspective view for describing the construction of the printing head 12 of this embodiment. In this example, a case is described in which the printing elements are elements for generating ink discharging energy used to eject ink (in an ink-jet printing method, each element comprises a pair of electrodes and a heating resistor 901 provided between these electrodes). In accordance with the method described below, the full-line printing head 12, which is fabricated without defects over its entire width by a conventional technique such as photolithographic machining, is obtained at a very high yield. Moreover, a single plate member 2000 having a plurality of ink discharge ports formed in one end and a plurality of grooves communicating these ink discharge ports formed on the plate member 2000 from one end to the other, is joined to this printing head 12 in such a manner that the grooves are closed by the heater boards, whereby a full-line, ink-jet printing head unit can be manufactured in a very simple manner.

The ink-jet printing head described in this embodiment has ink discharging ports (nozzles) at a density of 360 dpi (70.5 $\mu$m), the number of nozzles thereof being 3008 (for a printing width of 212 mm). Furthermore, the printing head 12 is constituted by m-number of heater boards 1000-1~1000-m, and the heater boards 1000-1~1000-m basically are composed of identical circuitry.

In FIG. 4, the heater board 1000 has 128 of the jetting-energy generating elements (heating resistors) 901 arranged at prescribed positions at a density of 360 dpi. Each heater board 1000 is provided with a signal pad, and with a power pad 1020 for supplying the driving power, to drive the heating resistors 901 at any timing by externally applied electric signals.

The row of the heater boards 1000-1~1000-m is fixedly bonded by a bonding agent to the surface of a base plate 3000 made of a material such as metal or ceramic.

Figure 5:
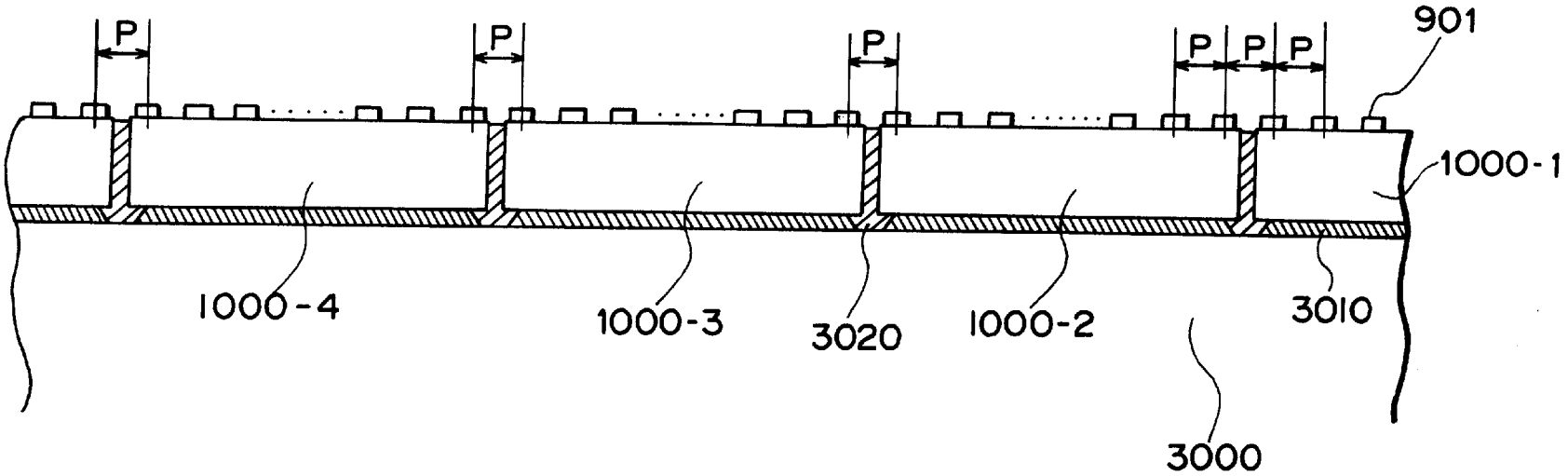
FIG. 5 is a detailed view showing heater boards arranged side by side.

FIG. 5 is a detailed view showing the heater boards in the arrayed state. The heater boards are fixedly bonded to a prescribed location on the base plate 3000 by a bonding agent 3010 applied to a prescribed thickness. At this time each heater board is fixedly bonded in precise fashion in such a manner that the pitch (spacing) between the heating resistors 901 situated at the respective edges of two mutually adjacent heater boards will be equal to the pitch P (=70.5 μm) of the heating elements 901 on each heater board. Further, the gaps produced between adjacent heater boards are filled and sealed by a sealant 3020.

With reference again to FIG. 4, a printed circuit board 4000 is fixedly bonded to the base plate 3000 in the same manner as the heater boards. At this time the printed circuit board 4000 is bonded to the base plate 3000 in a state in which the pads 1020 on the heater boards are in close proximity to signal-power supply pads 4010 provided on the printed circuit board 4000. A connector 4020 for receiving a printing signal and driving power from the outside is provided on the printed circuit board 4000.

The plate member 2000 having the plural grooves will now be described.

Figure 6D:
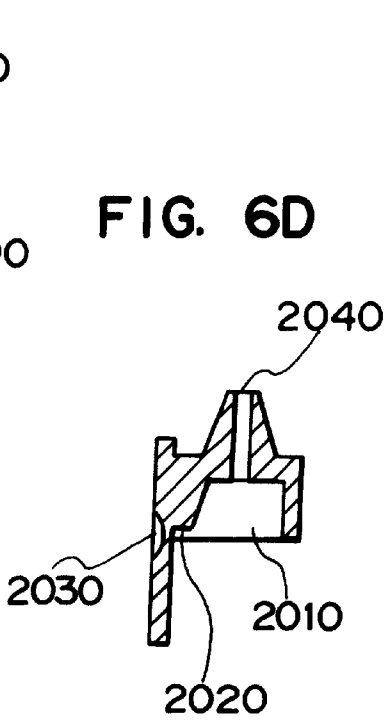
FIGS. 6A trough 6D show the shapes of a plate member.
Figure 6A:
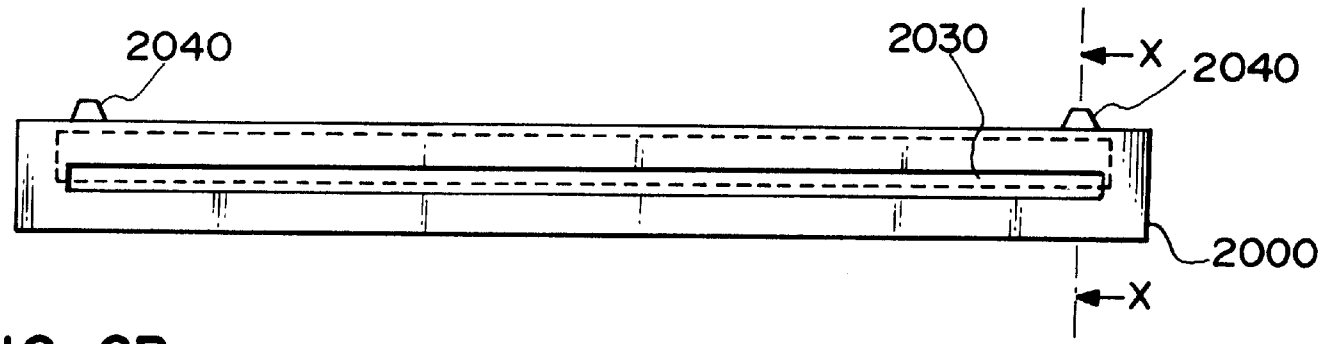
Figure 6B:
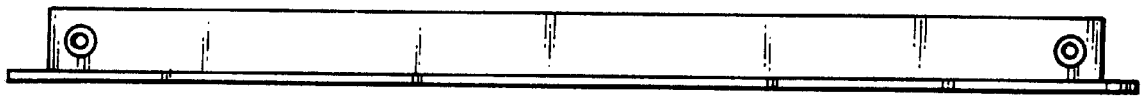
Figure 6C:
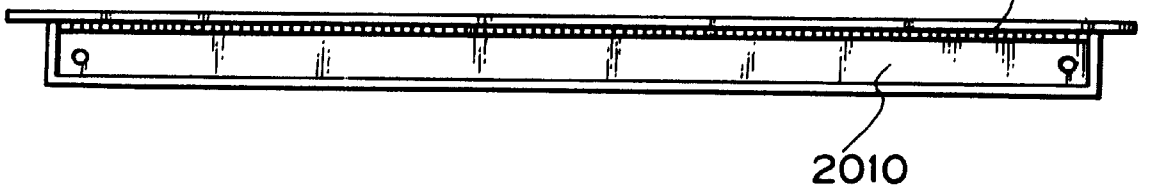

FIGS. 6A~6D are diagrams showing the shape of the plate member 2000. FIG. 6A is a front view in which the plate member 2000 is seen from the front, 6B a top view in which FIG. 6A is seen from the top, 6C a bottom view in which FIG. 6A is seen from the bottom, and FIG. 6D a sectional view taken along line X—X of FIG. 6A.

In FIGS. 6A~6D, the plate member 2000 is shown to have a flow passageway 2020 provided to correspond to each heating resistor 901 provided in the heater board 1000, an orifice 2030 corresponding to each flow passageway 2020 and communicating with the flow passageway 2020 for discharging ink toward the recording medium, a-liquid chamber 2010 communicating with each flow passageway 2020 in order to supply it with ink, and an ink supply port 2040 for feeding ink, which has been supplied from an ink tank (not shown), to the liquid chamber 2010. The plate member 2000 naturally is formed to have a length large enough to substantially cover the row of ink ejecting-energy generating elements 901 arranged by lining up a plurality of the heater boards 1000.

With reference again to FIG. 4, the plate member 2000 is joined to the heater boards 1000 in a state in which the positions of the flow passageways 2020 are made to exactly coincide with the positions of the heating resistors 901 on the heater boards 1000 arranged in a row on the base plate 3000.

Conceivable methods of joining the plate member 2000 are a method in which the plate member is pushed in mechanically using springs or the like, a method in which the plate member 2000 is fixed by a bonding agent, and a method which is a combination of these methods.

Figure 7:
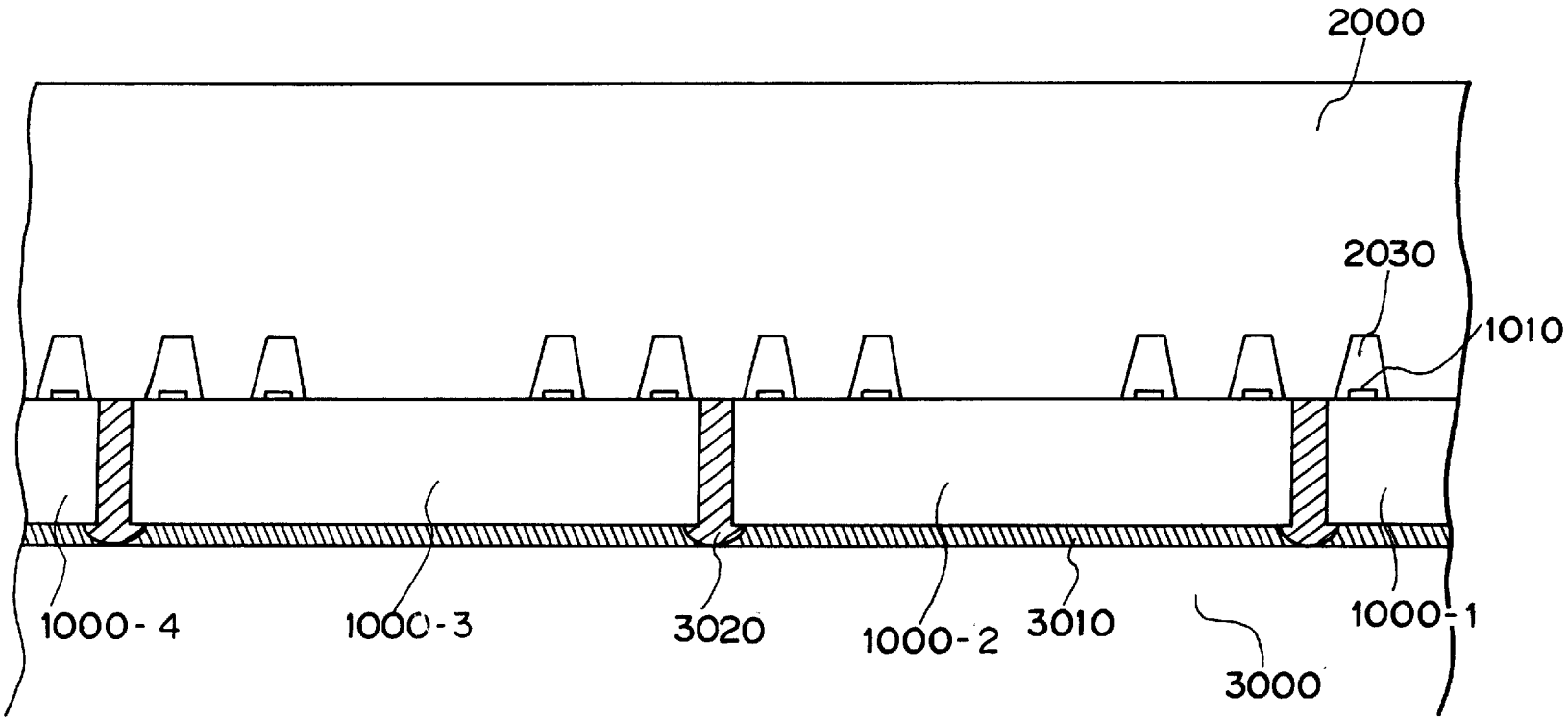
FIG. 7 is a diagram showing the plate member and heater boards in a fixed state.

The plate member 2000 and each of the heater boards are secured in the relationship shown in FIG. 7 by any of these methods.

The plate member 2000 can be manufactured using well-known methods such as machining by cutting, a molding method, injection method or a method relying upon photolithography.

Figure 12:
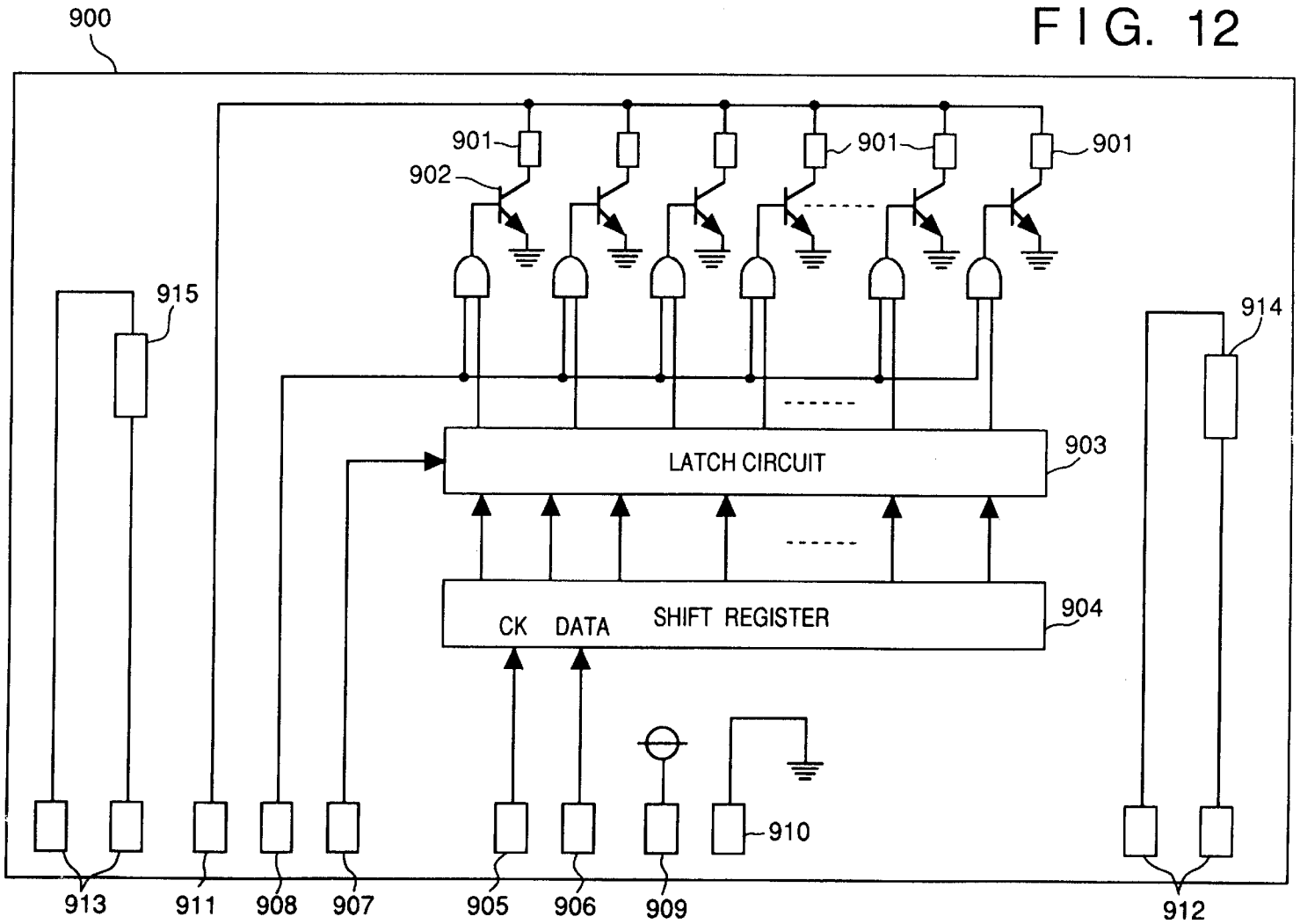
(PRIOR ART) FIG. 12
FIG. 12 is a diagram showing the circuit arrangement on a heater board of a conventional printing head.

FIG. 8 is a block diagram showing an example of circuitry on the heater board 1000 of the printing head 12 in a second embodiment of the present invention. Components identical with those on the heater board of the conventional printing head shown in FIG. 12 are designated by like reference numerals.

The heater board 1000 of the printing head 12 has a selecting circuit 101 for selecting preheating pulse width described later with reference to FIGS. 10 and 11; a latch circuit 102 for storing selection data which selects preheating pulses 103; the latch circuit 903 for latching printing data; the shift register 904 which, in sync with a shift clock 116, holds serially inputted printing data 117 or selection data for selecting preheating pulses 103; terminals 110 for entering preheating pulses 103 provided by a controller in the ink-jet printing apparatus of this embodiment; and terminals 111 for selecting and latching selection data latched by the latch circuit 102 and for entering signals to read out the data. On the assumption of a case in which the latch circuit 102 comprises a number of stages, it is so arranged that a plurality of latch clocks and readout signals can be entered from the terminals 111. When the latch circuit 102 is composed of a number of stages, the number of signal lines from the latch-circuit 102 to the selecting circuit 101 is the same as the number of stages. Numeral 107 denotes an OR circuit which, in dependence upon the printing data, combines the heating pulse outputted from an AND gate 106 and a preheating pulse signal selected and outputted by the selecting circuit 101.

Figure 9:
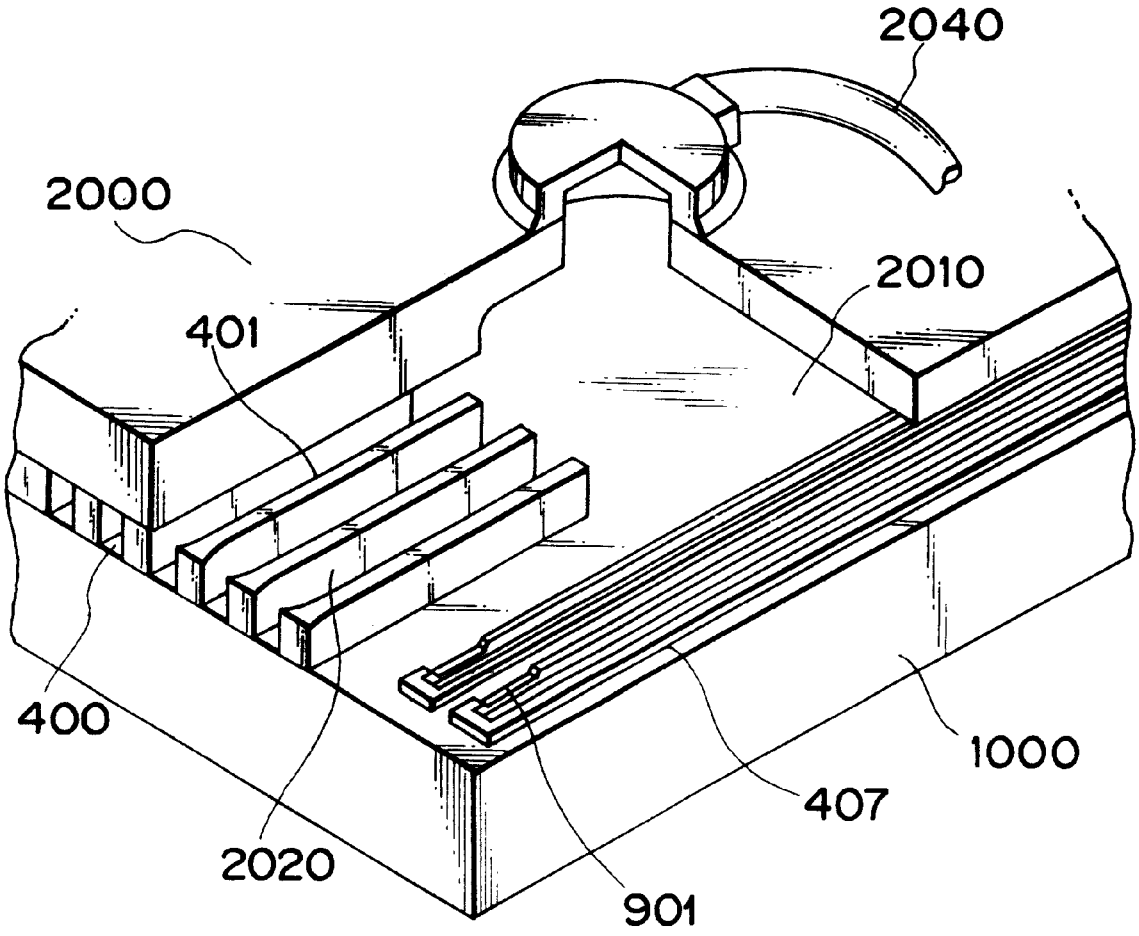
FIG. 9 is a structural view showing the construction of a printing head according to the second embodiment.

FIG. 9 is a perspective view showing the structure of the heater board 1000 in the printing head of this embodiment. Flow passageway wall members 401 for forming the flow passageways 2020 communicating with a plurality of discharge ports (nozzles) 400 and the plate member 2000 having the ink supply passage 2040 are attached. Ink supplied through the ink supply passage 2040 collects in the common liquid chamber 2010 and is supplied to each of the flow passageways 2020. By supplying current to the heating resistors 901 on the heater board 1000 in dependence upon the printing data, ink is discharged from the discharge ports 400 to perform printing.

The general operation performed by the foregoing arrangement will now be described with reference to FIG. 8.

After power is introduced to the apparatus, the preheating pulse width of each heating resistor 901 is decided in dependence upon the characteristic of the amount of ink discharged (per impression of a prescribed pulse at a fixed temperature) from each discharge port (heating resistor) in conformity with each heater board. The characteristic is measured in advance. Selection data for selecting the decided preheating pulse width corresponding to each discharge port (nozzle) is transferred to the shift register 904 in sync with the shift clock 116. Thereafter, the latch clock 111 is outputted to latch the selection data in the shift register 904 to the latch circuit 102. It should be noted that the above-mentioned characteristic of the amount of discharged ink in conformity with each heater board is stored in the memory 13 on the heater board 1000 of the printing head 12 in this embodiment. However, it may be arranged to store the characteristic in a memory (ROM 1702 in FIG. 16) of a controller, described later. Thus, in accordance with this embodiment, as indicated at point a in FIG. 8, the output of the shift register 904 is outputted to the latch circuit 903 for holding printing data and to the latch circuit 102 for holding the selection data of the preheating pulse, and the shift register 904 for entering image data is used also as a register for entering the selection data for selecting the preheating pulse. As a result, a shift register which enters the selection data for selecting preheating pulse width can be eliminated. This makes it possible to suppress an increase in the scale and size of the circuitry even if the latch circuit 102 for holding the selection data is provided in multiple stages.

Further, by providing the latch circuit 102 in a plurality of stages, a number of preheating pulses can be enhanced. Alternatively, this will make it possible to easily deal with a case in which the selection data exceeds the number of stages of the shift register 904.

The selection data for selecting the preheating pulse can be saved at one time, such as when the printing apparatus is started up. Accordingly, even if this function is provided, the sequence for transfer of printing data to the printing head 12 will be exactly the same as in the prior art. However, in consideration of a change (data blurring), produced by noise or the like, in the selection data stored in the latch circuit 102, it is preferred that the data be saved in the latch circuit 102 again during non-printing intervals.

Input of a heating pulse 105 after the selection data for selecting the preheating pulse is latched in the latch circuit 102 will now be described. This embodiment is characterized by separately providing the heating pulse 105 and a plurality of preheating pulses 103, which are for changing the amount of ink discharged.

First, a signal from the resistance sensor 914 for monitoring the resistance values of the heating resistors 901 is fed back and the pulse width of the heating pulse 105 is decided in dependence upon the resistance value in such a manner that energy suitable for discharging ink will be applied to the heating resistors 901.

With regard to the preheating pulses, these are decided by a controller in such a manner that the pulse width and timing of each of the plurality of preheating pulses 103 will change in dependence upon the value from the temperature sensor 915. Thus, the plurality of preheating pulses 103 can be set and applied in such a manner that the amount of ejected ink will be rendered constant for each nozzle even a prescribed temperature condition. Data relating to the amount of discharged ink from each discharge port (nozzle) is obtained from the memory 13, and the width of the preheating pulses 103 is set correspondingly, thereby rendering the amount of ink discharged constant to eliminate unevenness and streaks in the printed image. By using selection data for selecting preheating pulse thus entered and latched in the latch circuit 102, zero, one or several of the plurality of preheating pulses 103 can be selected to perform printing. In the description that follows, the term "'selection" covers no selection or one or multiple selection-of the preheating pulses 103, and the invention is not limited to an alternative selection.

By suitably contriving a method of selecting preheating pulse, the number of preheating pulses supplies to the heating resistors 901 can be increased further.

In this connection, the above-mentioned selection data and constructions of the selecting circuit 101 for selecting preheating pulse will be described with reference to FIGS. 10 and 11.

Figure 10A:
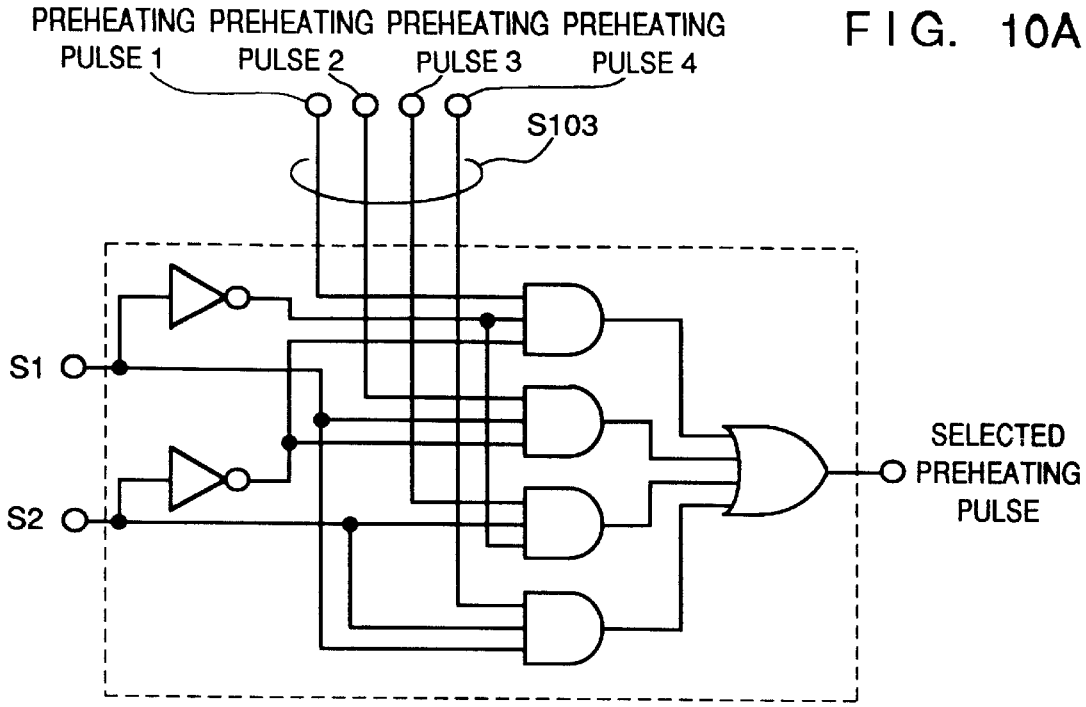
FIG. 10A is a diagram showing an example of a preheating selection circuit according to the second embodiment.
Figure 10B:
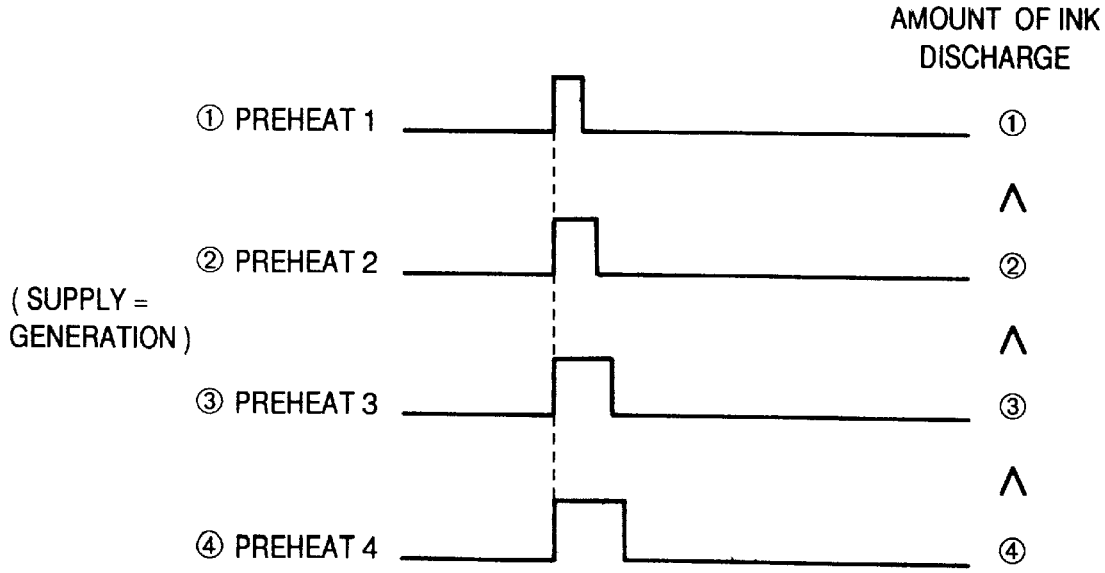
FIG. 10B is a diagram showing an example of preheating pulses.

FIG. 10 is a diagram for describing an example in which four types of preheating pulses 103 are supplied to control discharged amount of ink in four stages. FIG. 10A is a circuit diagram showing an example of the construction of the selecting circuit 101 for selecting desired pulses of the heating pulses 103, and FIG. 10B is a chart showing an example of these pulses. As will be evident from these diagrams, a preheating pulse 1 is selectively outputted when selection signals (S1, S2) delivered by the latch circuit 102 are (0,0); a preheating pulse 2 is selectively outputted when the selection signals (S1, S2) are (1,0); a preheating pulse 3 is selectively outputted when the selection signals (S1, S2) are (0,1); and a preheating pulse 4 is selectively outputted when the selection signals (S1, S2) are (1,1). As a result, the number of the preheating pulses 103 and the number of the output (selected) preheating pulses become equal.

Figure 11A:
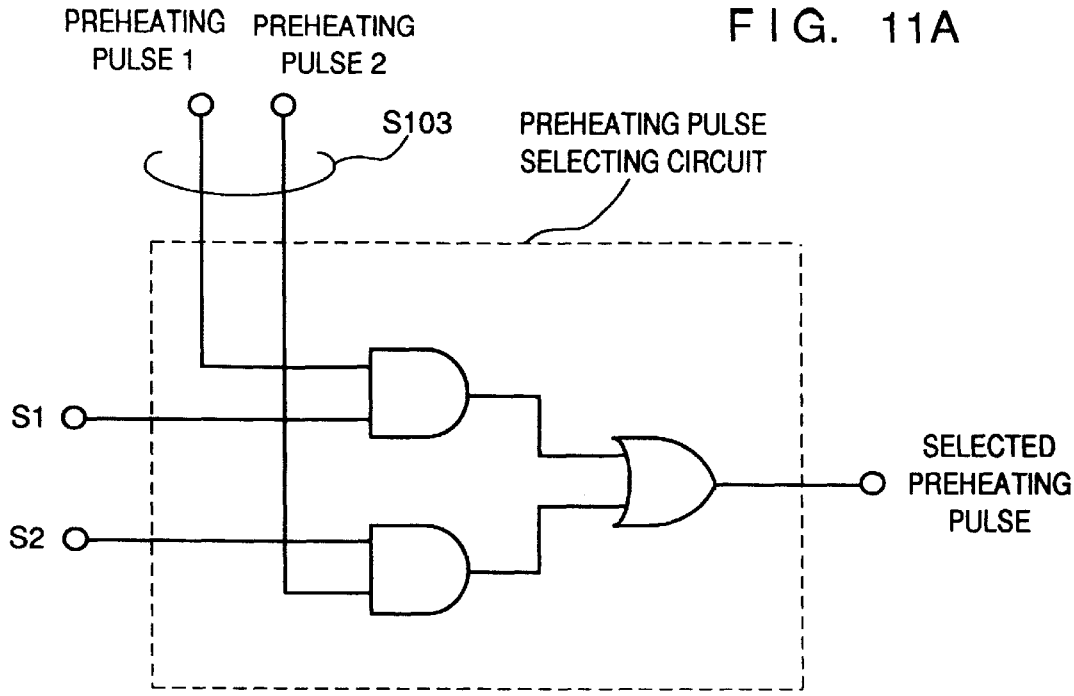
FIG. 11A is a diagram showing an example of a preheating selection circuit according to this embodiment.
Figure 11B:
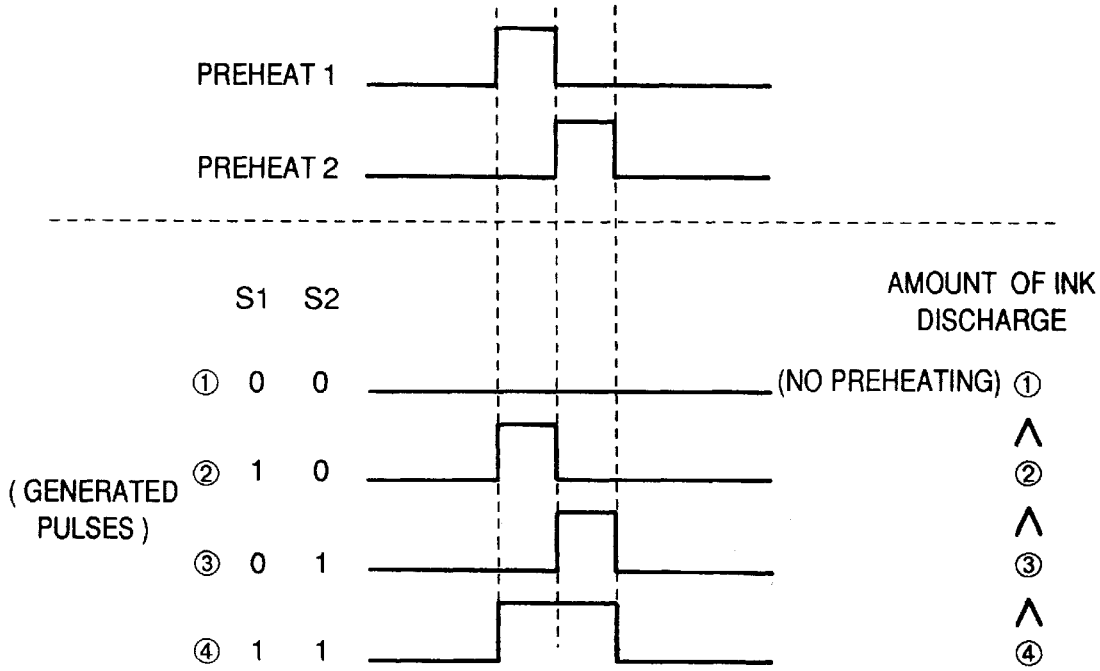
FIG. 11B is a diagram showing examples of preheating pulses and selecting the preheating pulses.

In FIG. 11, on the other hand, the outputted heating pulses are of four types with respect to preheating pulses 1, 2 (in one type there is no impression of preheating pulses). More specifically, in the circuit of FIG. 11A, no preheating pulse is produced when the selection signals (S1, S2) are (0,0); a preheating pulse 1 is outputted when the selection signals (S1, S2) are (1,0); a preheating pulse 2 is outputted when the selection signals (S1, S2) are (0,1); and the sum of preheating pulses 1 and 2 is outputted when the selection signals (S1, S2) are (1,1). FIG. 11B shows an example of preheating pulses 1 and 2 and outputs preheating pulses.

By adopting the circuit of FIG. 11A, the circuit area on the heater board can be made small and the size of the heater board can be made small. As a result, a maximum of eight types of preheating pulses can be produced even when, say, three types of preheating pulses 103 enter from the input terminal 110. Generally, in a case where P represents the number of preheating pulse signals 103 supplied, the types P' of preheating signals generated (the types of amounts of discharge) can be made a maximum of $2^P$.

By mounting the printing head 12 constructed as set forth above in the ink-jet printing apparatus of this embodiment and applying printing signals to the printing head 12, it is possible to obtain an ink-jet printing apparatus capable of performing high-speed, high-quality printing.

Figure 13:
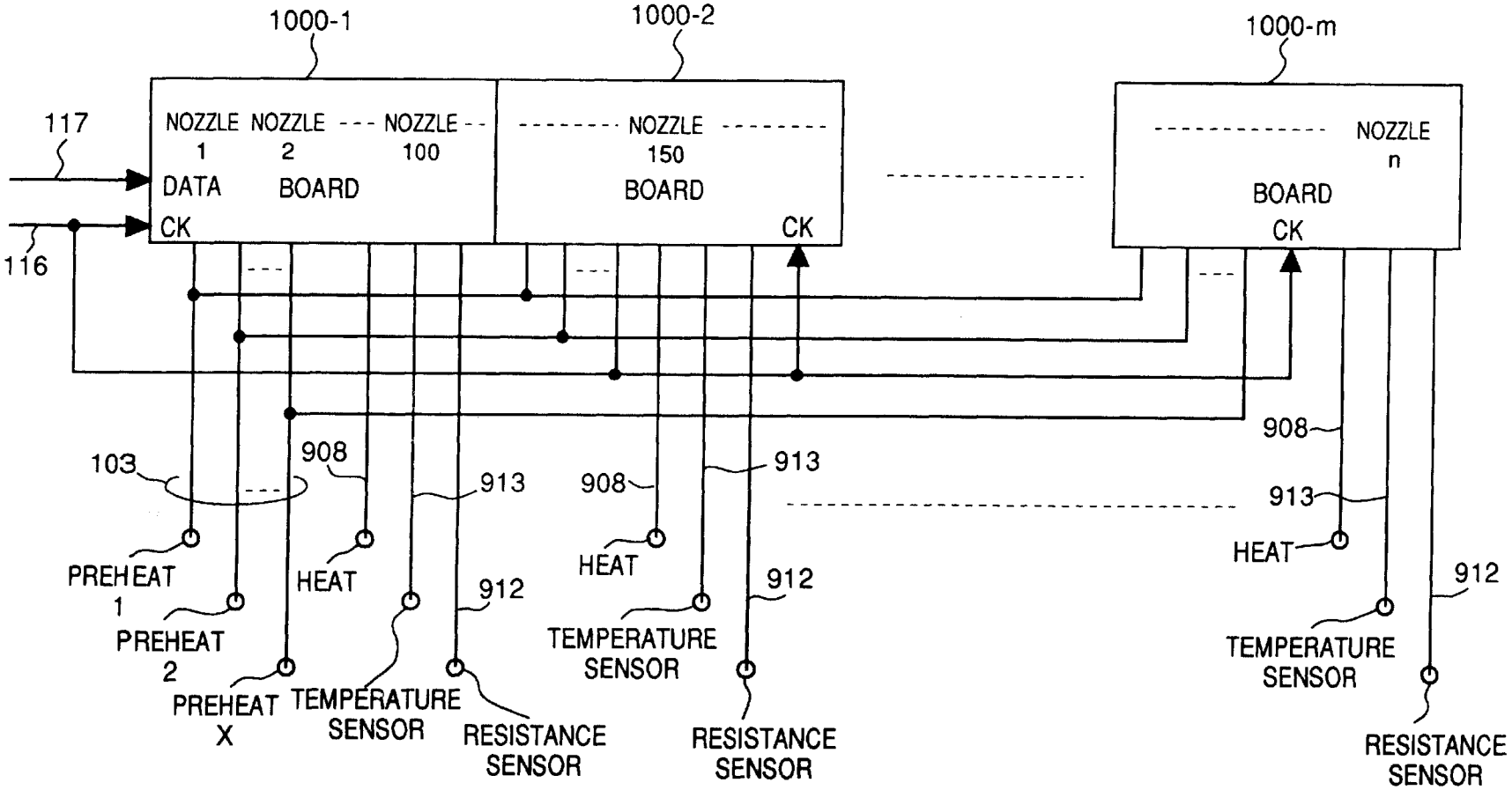
FIG. 13 is a block diagram showing a multiple-nozzle head constituted by an array of a plurality of heater boards.

FIG. 13 is a block diagram showing the construction of a multiple-nozzle printing head 12 in which a plurality of heater boards 1000-1~1000-m are arrayed in a row. In FIG. 13, the latch signals in each heater board are deleted from the drawing.

Here the printing head 12 having a total of n-number of nozzles is realized by using the m-number of heater boards 1000-1~1000-m. It should be noted that a serial input pad 906 of the heater board 1000-2 is connected to a serial output pad 104 of heater board 1000-1, and the serial output terminal 104 of each heater board is similarly connected to the serial input pad 906 of immediately preceding heater board.

The description below will focus on nozzles 1 and 100 of the heater board 1000-1 and nozzle 105 of the heater board 1000-2.

Figure 14:
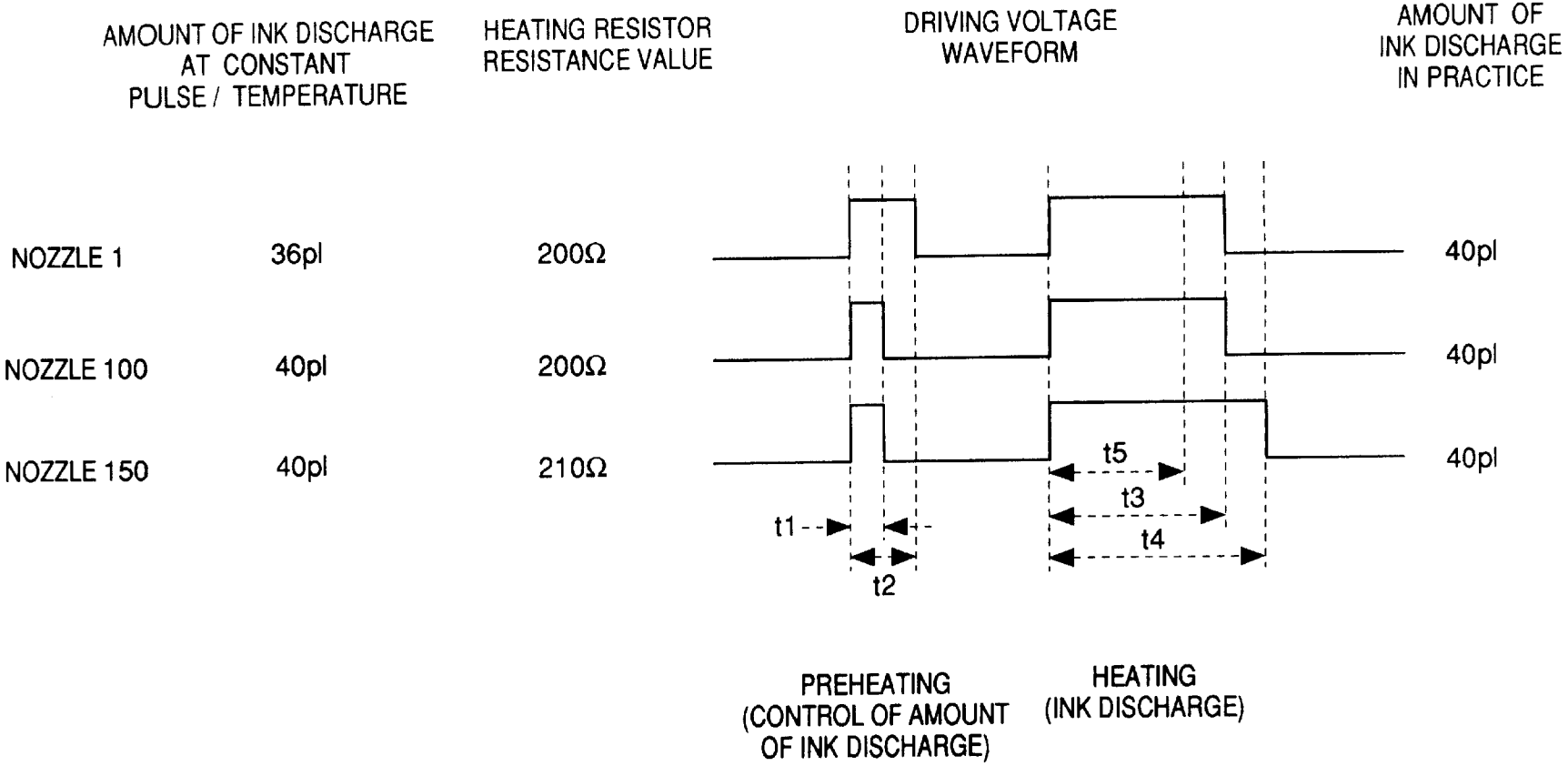
FIG. 14 is a diagram showing driving current waveforms for driving the printing elements of FIG. 13.

As shown in FIG. 14, assume that the amounts of ink discharged by nozzles 1, 100 and 150 are 36 pl, 40 pl and 40 pl, respectively, at impression of a constant pulse width at a constant temperature. The selection data, latched in the latch circuit 102, with respect to nozzles 100, 150 is set in such a manner that (S1,S2)=(1,0) is established, as indicated at (2) in FIG. 11B. Further, the selection data with respect to nozzle 1 having the small amount of ink discharge is set in such a manner that (S1,S2)=(1,1) is established, as indicated at (4) in FIG. 11B. Since it is known from the resistance sensor 914 that 200 Ω holds for the heater board 1000-1 and 210 Ω holds for the heater board 1000-2 with regard to the main heating pulses 105, the heating resistors 901 are driven by setting the width of the main heating pulse applied to the heater board 1000-2 to be greater than that applied to the heater board 1000-1 so that the energy applied to the heater boards 1000-1 and 1000-2 will be approximately constant. FIG. 14 illustrates driving current waveforms (preheating pulse and main heat pulse) applied to the nozzles 1, 100 and 150 under these conditions.

It will be understood that the preheating pulse of nozzle 1 which discharges a small amount of ink has a pulse width larger than that of the preheating pulses for nozzles 100 and 150 ($t1<t2$). Further, the main heating pulse width t4 for nozzle 150 is larger than that (t3) for the nozzles of heater board 1000-2 ($t4>t3$), as mentioned above. If FIG. 14, t5 represents the minimum heating pulse width needed to foam the ink and cause the ink droplets to eject from the nozzles. The following relationship holds: $t1, t2<t5<t3, t4$.

Thus, in accordance with this embodiment, the width of the preheating pulses is changed under conditions in which the relations (t1<t2), (t1, t2<t5) hold with respect to a change in the temperature of the heater board during printing. As a result, the amount of ink discharged from each nozzle can be made approximately 40 pl at all times. This makes it possible to print a very high-quality image without the occurrence of uneven density or streaks. Furthermore, with regard to the heating pulses, the pulse width is adjusted in dependence upon the resistance values of the heating resistors of each heater board, whereby a constant energy is applied without waste. This makes it possible to extend the service life of the heating resistors.

Figure 15:
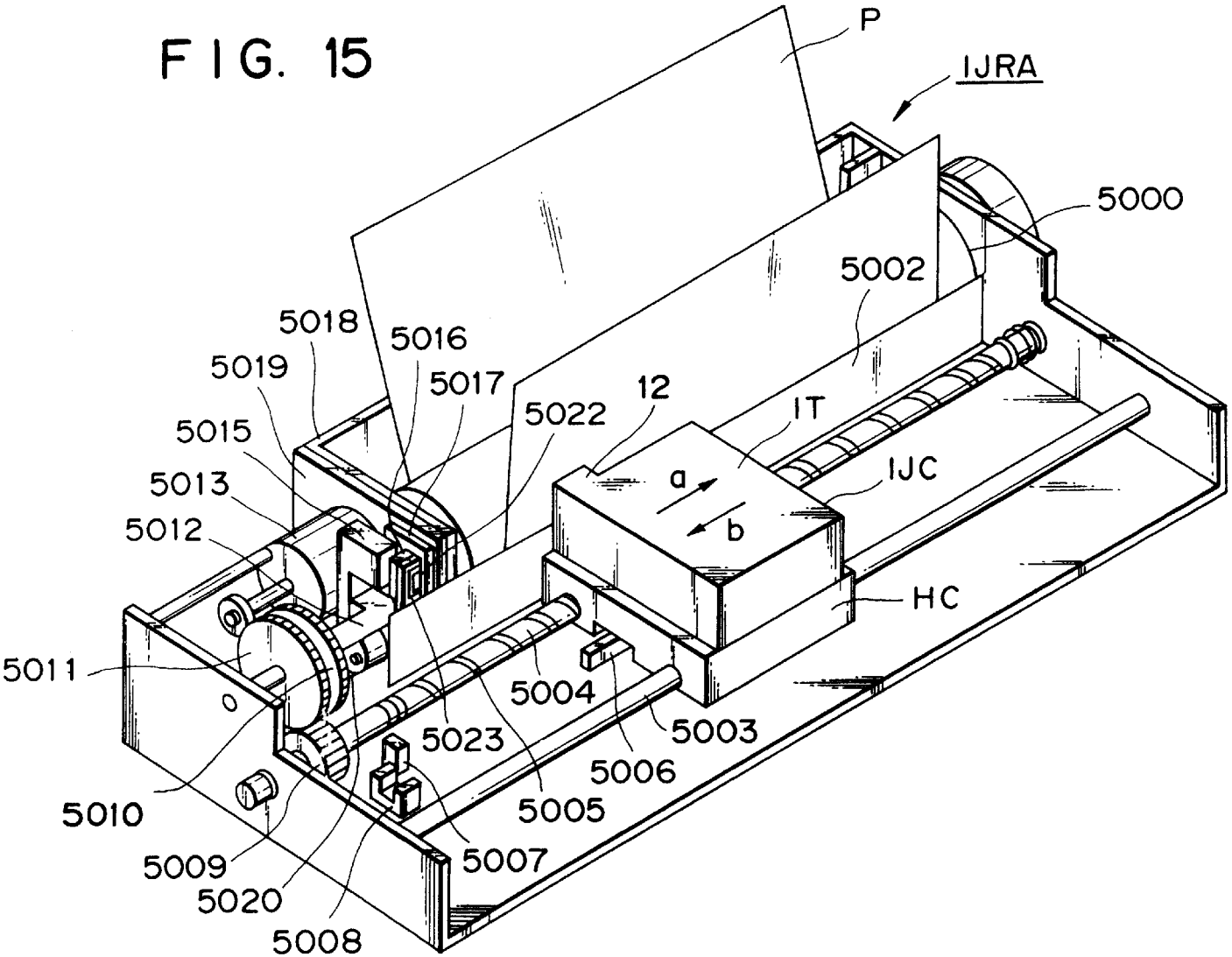
FIG. 15 is an external perspective view showing the principal portions of an ink-jet printing apparatus according to this embodiment.

FIG. 15 is an external view of an ink-jet printing apparatus IJRA to which the present invention can be applied.

In FIG. 15, a lead screw 5005 is rotated via driving-force transmission gears 5011, 5009 in operative association with the forward-reverse rotation of a drive motor 5013. A carriage HC engaged with a helical groove 5004 formed in the lead screw 5005 has a pin (not shown) and is moved back and forth in the directions of arrows a, b. An-ink-jet cartridge IJC is mounted on the carriage HC. A paper retaining plate 5002 presses a sheet of paper against a platen 5000 along the direction in which the carriage HC moves. Photocouplers 5007, 5008 serve as home-position sensing means for sensing the presence of a lever 5006 provided on the carriage HC in order to change over the direction of rotation of the drive motor 5013. Numeral 5016 denotes a member supporting a cap member 5022 which caps the front side of the printing head 12, and number 5015 denotes suction means for sucking ink via an opening 5023 of the cap from the nozzles of the printing head 12, to restore the printing head 12. Numeral 5017 denotes a cleaning blade and 5019 a member which makes it possible to move the blade 5017 back and forth. These are supported on a supporting plate 5018. It goes without saying that the blade 5017 applied to this example is not limited to the illustrated blade but can be any well-known cleaning blade. Numeral 5012 denotes a lever for starting the starting the sucking operation in suction restoration. The lever 5012 moves to accompany rotation of a cam 5020 engaged with the carriage HC, and the movement thereof is controlled by well-known transmission means such as a clutch for changing over the driving force from the driving motor 5013.

These capping, cleaning and suction restoration operations are carried out by executing the desired processing at corresponding positions through the action of the lead screw 5005 when the carriage HC has arrived in an area on the side of the home position. If the desired operations are performed at the well-known timing, these operations can be applied to this example.

<Description of Control Arrangement>

Figure 16:
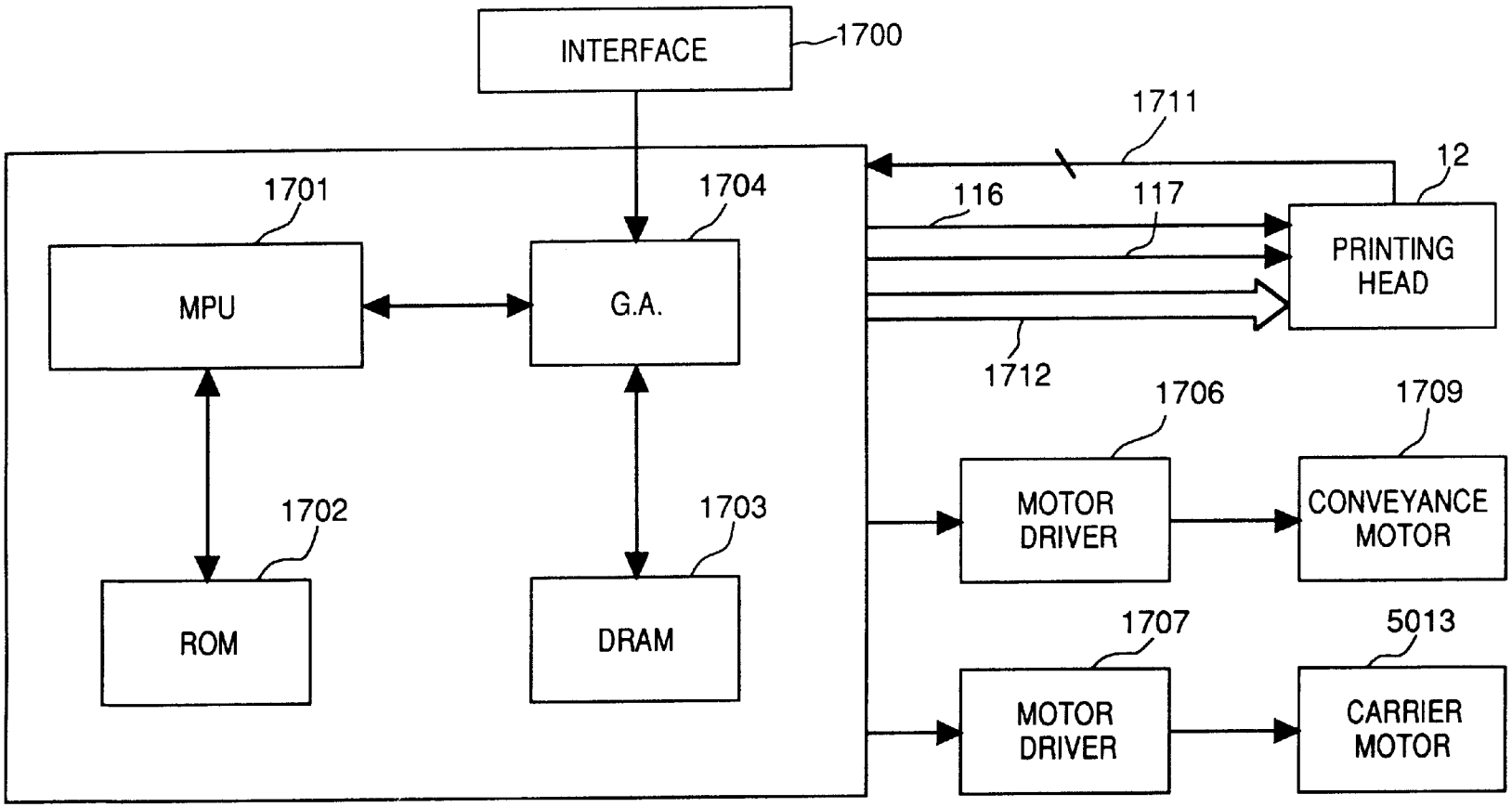
FIG. 16 is a block diagram showing the general construction of the printing apparatus of FIG. 15.

An arrangement for executing control of printing in the apparatus set forth above will now be described with reference to the block diagram of FIG. 16. Shown in FIG. 16 are an interface 1700 for entering a printing signal, an MPU 1701, a program ROM 1702 for storing a control program executed by the MPU 1701, a dynamic RAM 1703 for saving various data (the above-mentioned printing signal and printing data that is supplied to the head 12), and a gate array 1704 for controlling supply of printing data to the printing head 12. The gate array 1704 also controls transfer of data among the interface 1700, MPU 1701 and RAM 1703. Also shown are the drive motor (carrier motor) 5013 for conveying the printing head 12, a conveyance motor 1709 for conveying recording paper, motor drivers 1706, 1707 for driving the conveyance motor 1709 and the carrier motor 5013, respectively, a signal line 1711 for monitoring the sensors 914, 915 of each heater board of the printing head 12 as well as the memory 13 of the printing head 12, and a-signal line 1712 for carrying the preheating pulses, latch signals and heating pulses (main heating pulses).

Figure 17:
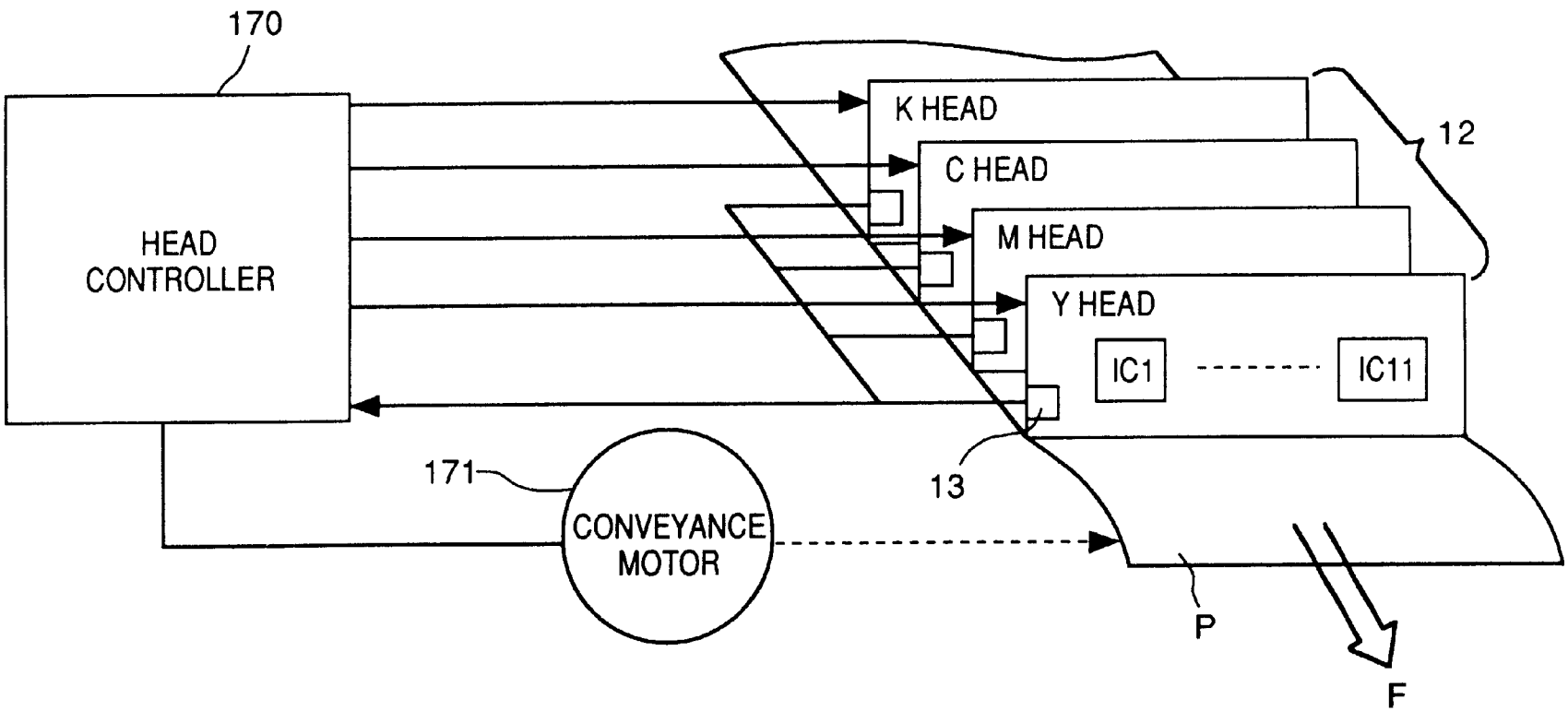
FIG. 17 is a diagram showing the construction of an ink-jet printer according to another embodiment.

FIG. 17 is a diagram showing the general construction of a color ink-jet printer having a line-type head according to another embodiment. The printer has four ink-jet heads (each of which has a length of about 10 cm) for respective ones of four colors and performs printing by conveying a recording paper P in the direction of arrow F. Numeral 170 denotes a head controller for supplying printing data to the heads and for controlling heating, and numeral 171 designates a paper-feed motor for conveying the recording paper P. The ink-jet heads 12 (Y, M, C, K heads) corresponding to the respective colors are each constituted by 11 heater boards indicated at IC1~IC11. The arrangement is shown in FIG. 18.

Figure 18:
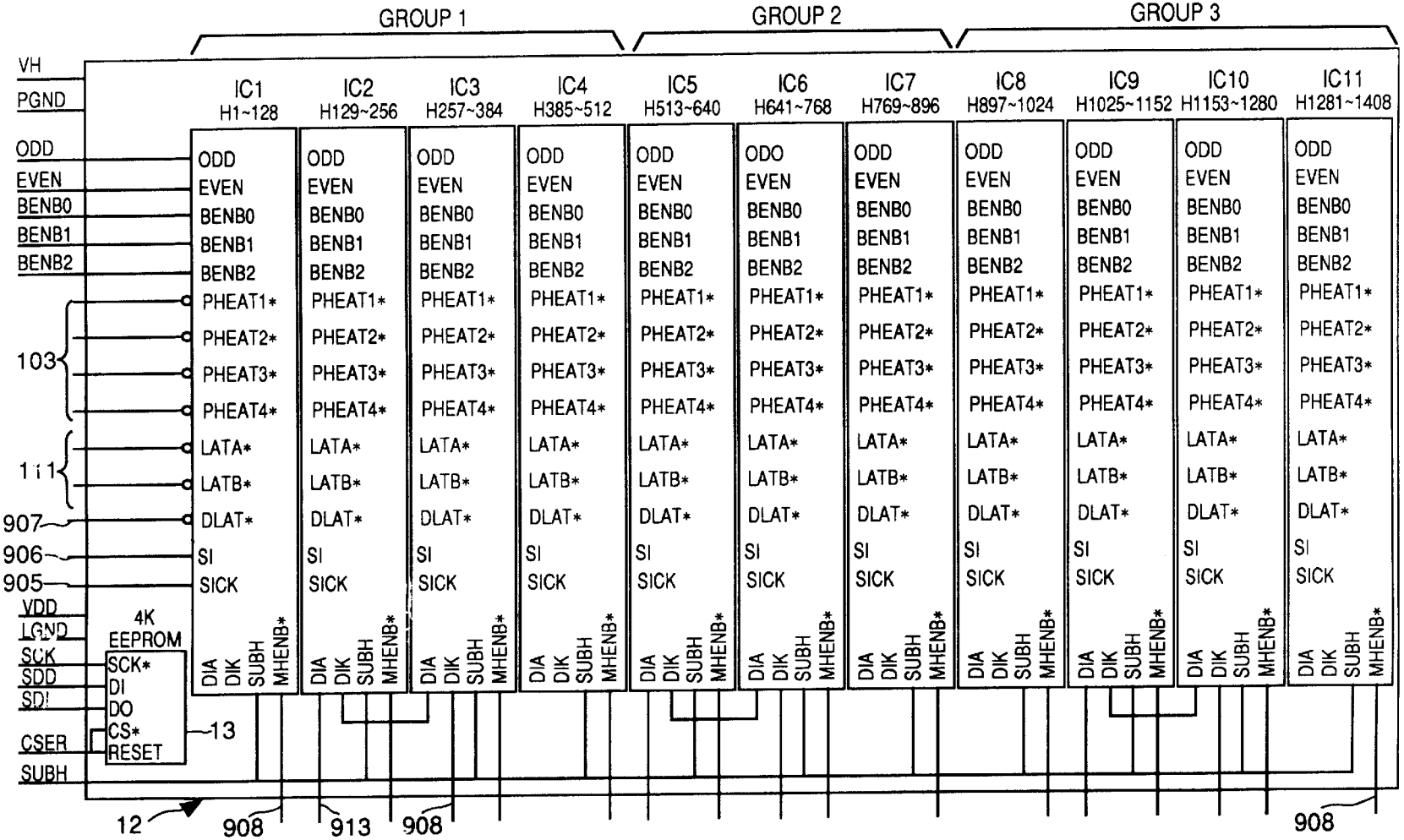
FIG. 18 is a circuit diagram showing the construction of a printing head for one color in FIG. 17.

Components in FIG. 18 identical with those in the foregoing diagrams are designated by like reference numerals. Each heater board is equipped with 128 heating resistors. VH and PGND indicate power supply lines and ground lines of the heating resistors 901; ODD and EVEN represent control signal terminals for feeding current separately to odd- and even-numbered heating resistors 901; and BENB0–2 denote block selection signals which prevails when the heating resistors are electrified in block units in one heater board. The circuits of the heater board corresponding to these signals are shown in abbreviated form in FIG. 8, etc.

PHEAT 1~4 of the preheating pulse signals 103 corresponds to preheat 1~4 in FIG. 10B, for example, and the latch signals 111 are latch signals for latching the selection signals S1, S2 of FIG. 10A in the latch circuit 102. Numeral 13 denotes an EEPROM for storing the drive conditions (data) of the printing head 12. Numeral 908 denotes the main heating pulse applied to each heater board, and 913 a signal for detecting the temperature of each heater board.

The printing data sent to each heater board is 128-bit data for turning each of the 128 heating resistors 901 on and off. This data is transferred whenever one line is printed and is latched in the latch circuit 903 by the latch signal 118 (FIG. 8). More specifically, each heating resistor 901 is turned on and off in dependence upon both the main heating pulse and the printing data. The preheating pulse, on the other hand, is outputted irrespective of the printing data.

The selection data latched in the latch circuit 102 is data for individually setting the preheating pulse widths of the 128 heating resistors 901. Two bits (S1, S2) correspond to one heating resistor 901 and therefore the selection data is composed of a total of 256 bits. The 256-bit selection data is transferred to each heater board only one time before printing, e.g., when the power supply is turned on, and is held continuously in the latch circuit 102, which is composed of two stages. The two-bit selection data is outputted to the selecting circuit 101 from the latch circuit 102 and, as shown in FIG. 10 or 11, is used to select any one or two of the four preheating pulses BPHEAT 1~4 in accordance with the selection data.

Figure 19:
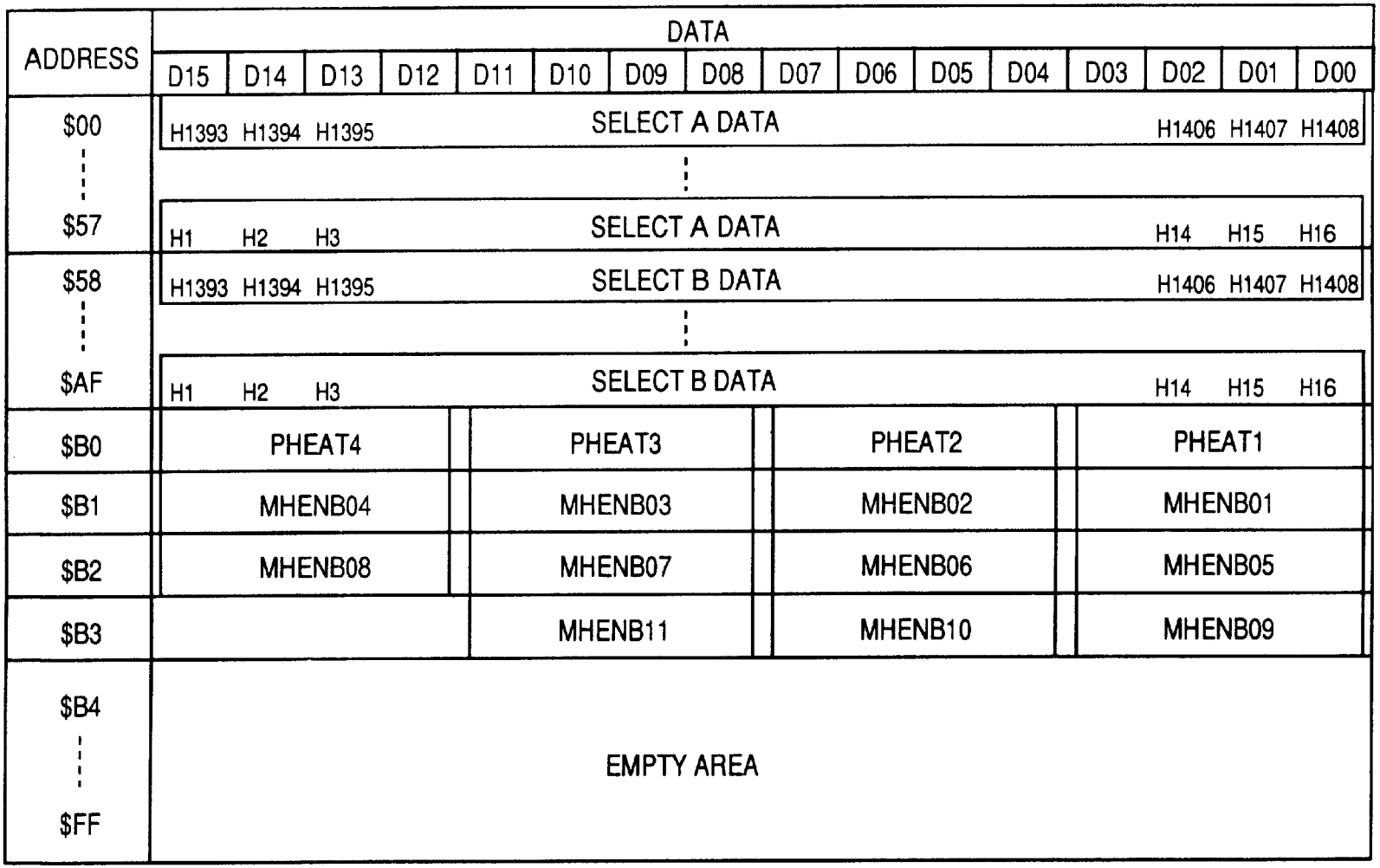
FIG. 19 is a diagram showing an example of the constitution of data in a memory (EEPROM)

FIG. 19 is a diagram showing the constitution of the data in the memory 13 (EEPROM) of printing head 12.

The data stored in the memory 13 is selection data (select A data and B data: corresponding to S1, S2, respectively) for 1408 (128×11) heating resistors corresponding to 11 heater blocks (the above-mentioned heater boards 1000), setting data (PHEAT 1 ~4) indicating the pulse widths of the four types of preheating pulses (PHEAT 1~4), and setting data (MHEATB 01~11) indicating the pulses widths of the main heating pulses for each heater board 1000. These items of data are read out of the memory 13 by the head controller 170 (FIG. 17) or MPU 1701 (FIG. 16) prior to the start of printing and are referred to in the setting of the selection data in each heater board 1000.

Each item of the setting data PHEAT 1~4 is four-bit data representing 0~10 (1AH:H denotes hexadecimal). When the head 12 is manufactured, the density characteristic of each nozzle of the head 12 is measured by the above-described head correcting apparatus, and the setting data is selected as four widths, in which density is averaged optimally, from among 11 types (0.25–1.50 μsec) capable of being set as preheating pulse widths. The head controller 170 and MPU 1701 use a counter to generate the preheating pulses BPHEAT 1~4, whose widths are based upon the transferred values of the setting data PHEAT 1~4, and transfer the generated preheating pulses to each heater board.

As set forth above, the selection data thus transferred to each heater board prior to printing is latched in the latch circuit 102 of each heater board, and the selection circuit 101 selects any one of the preheating pulses PHEAT 1~4 based upon the selection data (A, B), whereby the heating resistors 901 are preheated.

FIG. 20 is a diagram showing an example in which such preheating pulses (PHEAT 1~4) are selected (See FIG. 10B).

Figure 21:
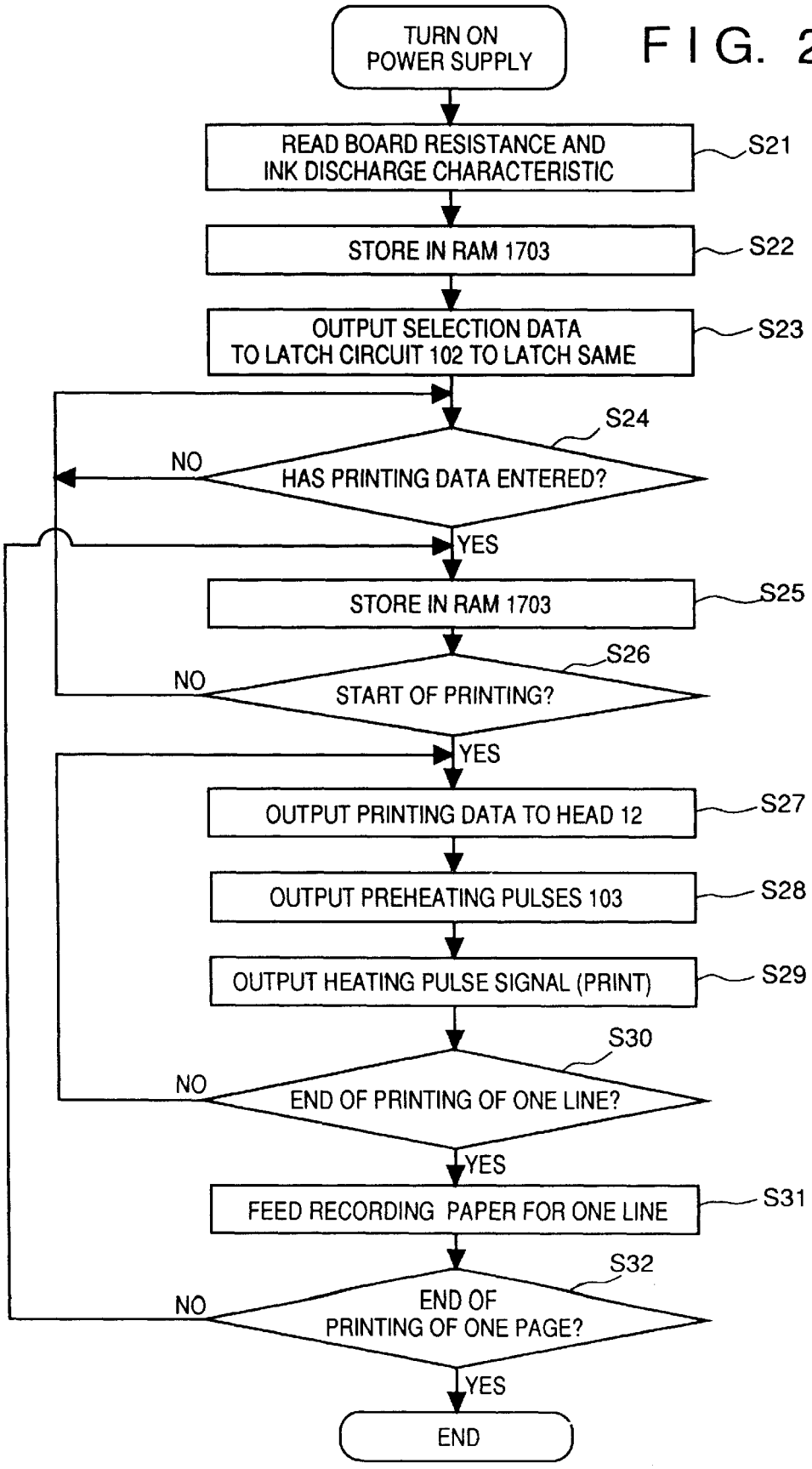
FIG. 21 is a flowchart showing printing processing in a printing apparatus using a printing head according to a second embodiment of the invention.

FIG. 21 is a flowchart showing printing processing from turn-on of the power supply to the end of printing of one page in, say, the ink-jet printing apparatus of FIG. 15 of this embodiment. The control program for executing-this processing is stored in the ROM 1702 and is executed by the MPU 1701. Processing is basically the same also in the apparatus of FIG. 17 with the exception of the fact that the latter apparatus performs color printing and has a line-type printing head.

The processing shown in FIG. 21 is started by turning on the power supply of the apparatus. At step S21 in the flowchart, the resistance values of the heating resistors on the heater boards 1000-1~1000-m (m-number of heater boards) of the printing head 12 and the ink discharge-quantity characteristic of each nozzle (discharge port) of each heater board are read. The read values are stored in the RAM 1703 at step S22. The resistance values of the heating resistors 901 are detected by the resistance sensor 914, and the ink discharge-quantity characteristic of each nozzle may be stored in, say, the memory 13 provided in the printing head 12, as shown in FIG. 19. Next, at step S23, the above-mentioned selection data is decided in conformity with the resistance values of the heating resistors of each heater board and the ink discharge-quantity characteristics, the selection data is transferred serially to the shift register 904 on each heater board of the printing head 12 and the selection data is latched in the latch circuit 102 of each heater board. When the latch circuit 102 is constituted by multiple stages, e.g. 2 stages as in this embodiment as shown in FIG. 8, the latch signal and select signal (these signals are collectively input from the terminals 111) are outputted and latched in the latch circuit 102 stage by stage.

Next, at step S24, it is determined whether printing data has entered from an external device (host computer), not shown, via the interface 1700. If printing data has input, the program proceeds to step S25, at which the received printing data is stored in the RAM 1703. Next, the program proceeds to step S26, at which it is determined whether one line of printing, for example, is capable of starting. If the answer is NO, the program returns to step S24. If the answer is YES, the program proceeds to step S27.

At step S27, printing data to be printed on an initial single row is transferred serially to the shift register 904. Next, the program proceeds to step S28, at which the output of the latch circuit 102 is supplied with the selecting circuit 101. The preheating pulses 103 are then supplied with all heater boards of the printing head 12. As a result, as shown in FIG. 10 or 11, one or some of the preheating pulses 103 are selected in dependence upon the selection signal (2 bits: S1, S2) from the latch circuit 102, whereby the printing head 12 is preheated. The program then proceeds to step S29, at which the heating pulses (main heating pulses) 105 are outputted to each heater board to actually print an image.

The reception of data from the host computer and the transfer of the next series of print data to the shift register 904 of each heater board are carried out even during preheating processing or heating processing (output of the main pulses) for actual printing. Further, when the printing head 12 is composed of the plurality of heater boards 1000-1~1000-m, as shown in FIG. 13 or FIG. 18, an arrangement may be adopted in which the heating resistors are electrified on a per-board basis at staggered times instead of the arrangement in which the heating resistors of all heater boards are electrified simultaneously at step S29. By virtue of this arrangement, the capacity of the power supply of the apparatus can be reduced. Next, at step S30, it is determined whether the printing of one line has ended. If the printing of one line has not ended, the program returns to step S27 to repeat processing from this step.

When the printing processing for one line ends, the program proceeds from step S30 to step S31, where the conveyance motor 1709 is rotated to convey the recording paper in the sub-scan direction by an amount equivalent to one line. This is followed by step S32, at which it is determined the printing of one page has ended. If the answer is NO, then the program returns to step S25, at which it is determined whether reception of the next line of printing data has been completed. When the printing of one page of an image is finished by repeating the above-described operation, printing processing is terminated.

A printing head according to a third embodiment of the invention will now be described.

Figure 22:
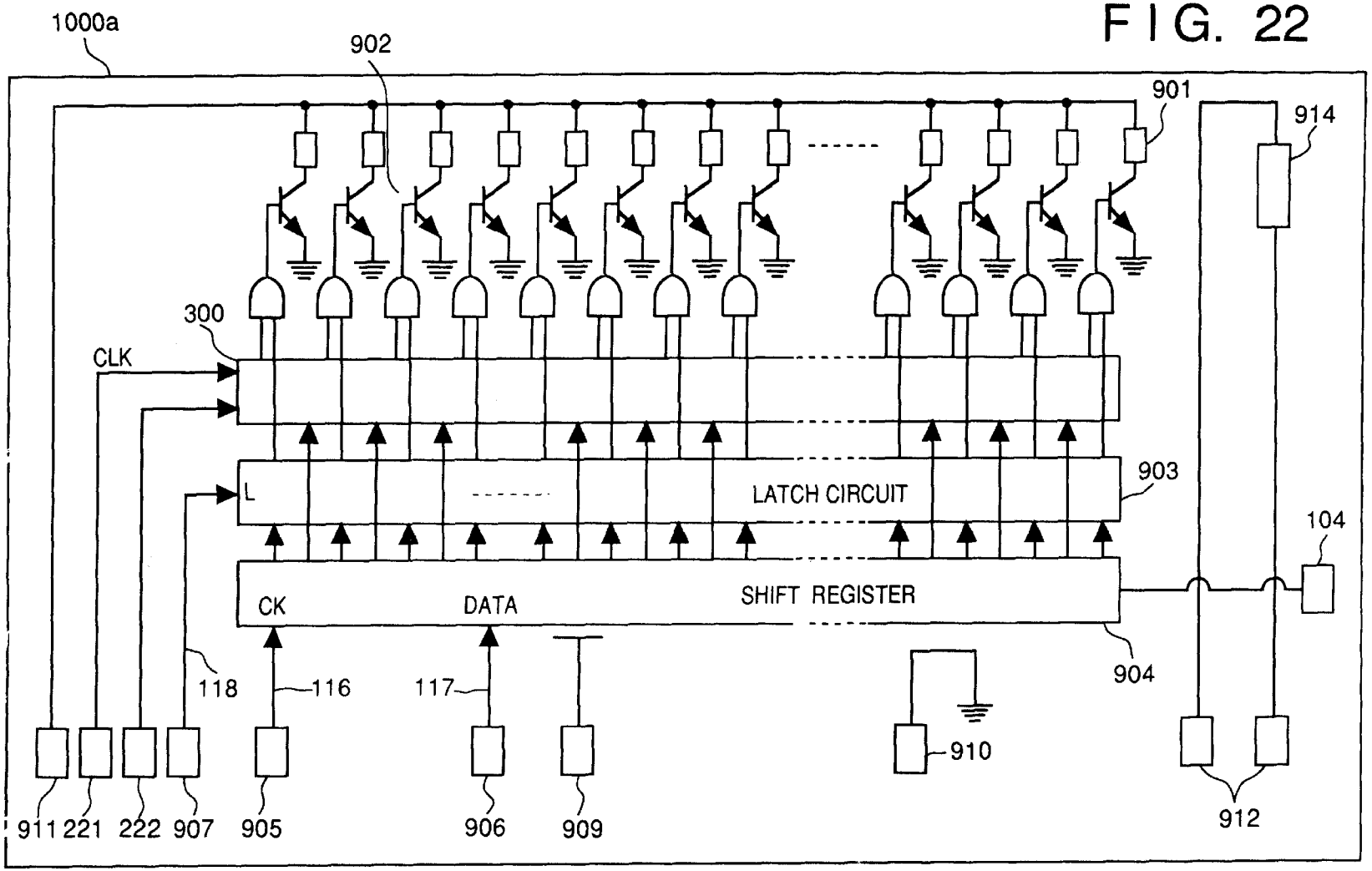
FIG. 22 is a diagram showing the circuit arrangement on a heater board of a printing head according to the third embodiment.

FIG. 22 is a block diagram illustrating an example of the circuit arrangement of a heater board 1000*a*, one of the heater boards of the printing head 12 of the inkjet printing apparatus IJRA of the third embodiment. Components in FIG. 22 identical with those of the heater board 1000 of the printing head shown in FIG. 8 are designated by like reference numerals.

In FIG. 22, numeral 1000*a* denotes the element substrate (heater board) of the printing head 12 of this embodiment, numeral 300 designates a heating-pulse generating circuit for deciding heating pulse width, described below with reference to FIGS. 23 and 24, and numeral 903 denotes the latch circuit for latching printing data. Printing data or data for deciding heating pulse width enters the shift register 904 serially in sync with the shift clock 116 and is held by the shift register 904. Numeral 221 denotes a terminal for entering the clock signal which decides the heating pulse width, and 222 denotes a latch clock for latching the data from the shift register 904 in the heating-pulse generating circuit 300.

Figure 23:
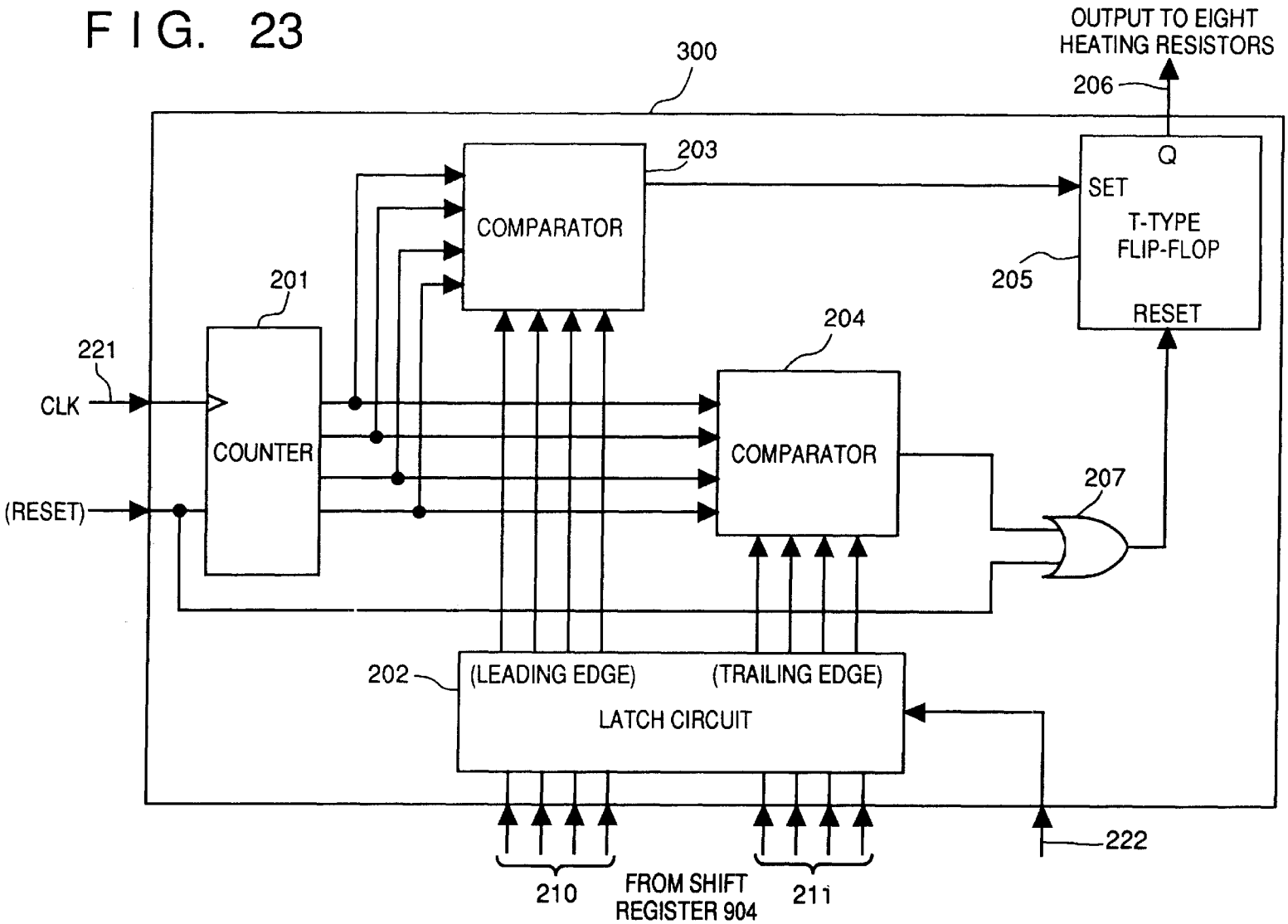
FIG. 23 is a block diagram showing the construction of a selecting circuit according to the third embodiment.
Figure 24:
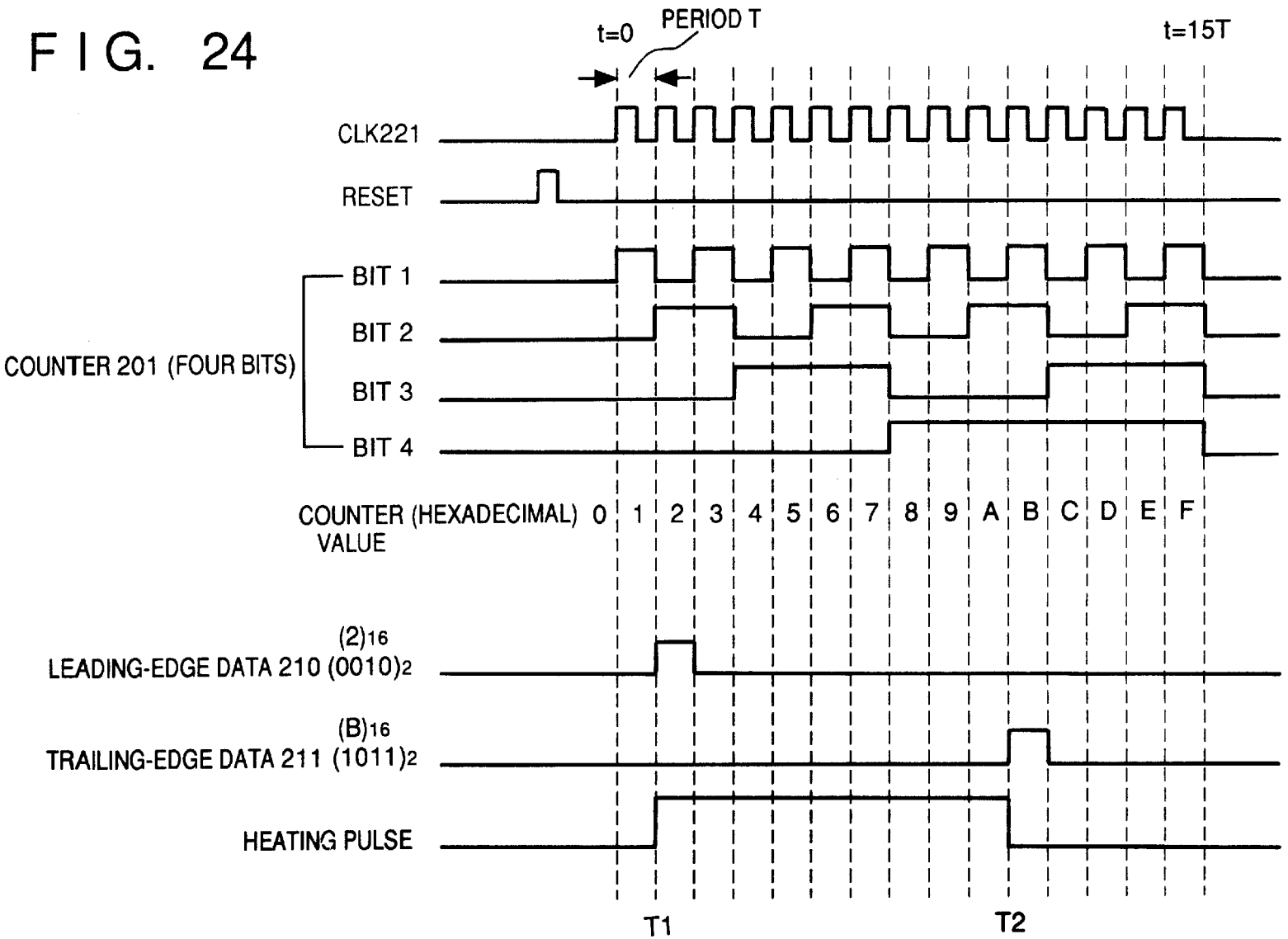
FIG. 24 is a diagram showing the operation timing of the circuit illustrated in FIG. 23.

FIG. 23 is a block diagram showing part of the construction of the heating-pulse generating circuit 300 of the third embodiment. This circuit generates the heating pulses for the heating resistors 901 in units of eight heating resistors. A four-bit counter 201 counts the clock signal 221 applied thereto. Data from the shift register 904 for deciding the width of the heating pulses of the eight heating elements is input an eight-bit latch circuit 202 and is latched thereby.

Comparators 203, 204 compare the output of the counter 201 and the outputs of the latch circuit 202 and output pulse signals when the compared signals agree. A set/reset-type flip-flop 205 is set by the output of comparator 203 and reset by the output of an OR circuit 207.

Numeral 210 denotes leading-edge data, which is supplied with the shift register 904, for deciding the leading-edge timing of the heating pulses, and numeral 211 denotes trailing-edge data, which is supplied with from the shift register 904, for deciding the trailing-edge timing of the heating pulses. In the example of FIG. 24, let the leading-edge data be "0010" (a binary number), and let the trailing-edge data be "1011" (a binary number), by way of example. As a result, when the output of the counter 201 agrees with the value (2) of the leading-edge data after the counter 201 has started counting in response to the clock signal (CLK) 221, the output of the comparator 203 attains the high level and so does the Q output of the flip-flop 205 (timing T1). As the counter 201 counts further and the output value thereof comes into agreement with the trailing-edge data (0BH), the output of the comparator 204 attains the high level and the flip-flop 205 is reset (timing T2). As a result, heating pulses for eight heating resistors 901 are generated and outputted.

In the third embodiment, heating pulse width is decided for each one of the prescribed number of heating resistors 901. However, this does not impose a limitation upon the invention. For example, the latch circuit 202 of FIG. 22 can be constructed of multiple stages and one-bit data from the shift register 904 can be entered and latched a total of eight times, whereby heating pulse widths in a plurality of stages can be decided in units of one heating resistor 901. In this case, it is required that the number of latch clocks 222 conform to the number of stages. Further, in the circuit of FIG. 23, an ideal arrangement is to provide a reset-signal input terminal, which is for inputting the reset signal (RESET) that is supplied with the MPU 1701, in order to prevent erroneous operation of the heating-pulse generating circuit 300. The counter 201 and flip-flop 205 are reset by this reset signal.

Further, the counter 201 is a four-bit counter in the third embodiment. However, the number of bits in the counter can be decided appropriately depending upon the pulse width of the heating pulses desired to be produced, the resolution of timing and the frequency of the clock 221. Further, if, in a case where it is desired to generate a plurality of heating pulse signals having different resolutions, the necessary number of pulses (the number of bits in the counter 201) is increased in order to conform to a finer resolution, signals having frequencies that differ from one another are generated using a plurality of the clock signals 221 and these signals are combined, thereby making it possible to generated heating pulse signals having mutually different resolutions without increasing the number of bits of the shift register 904.

The heating-pulse generating circuit 300 may be incorporated on the heater board 1000*a* in the printing head or it may be formed as an IC circuit and then mounted on the heater board 1000*a*. Further, the circuit of this embodiment can also be applied to a case in which all of the heating resistors 901 are not driven simultaneously but in segments in order to suppress an increase in power supply capacity.

Operation based upon the foregoing arrangement will now be described.

After the power supply of the apparatus is turned on, the heating pulse width of each heating resistor 901 is decided in dependence upon the characteristic of the amount of ink discharged (per impression of a prescribed pulse at a fixed temperature) from each discharge port (nozzle: heating resistor) in conformity with the heater board of the printing head 12. The characteristic is measured in advance. The leading-edge and trailing-edge data for deciding the heating pulse width corresponding to each discharge port is transferred to the shift register 904 in sync with the shift clock 116. Thereafter, the latch clock 118 is outputted to latch the leading-edge and trailing-edge data of the shift register 904 in the latch circuit 202 of the heating-pulse generating circuit 300. It should be noted that the above-mentioned characteristic of the amount of ink discharged in conformity with each heater board may be stored in the memory 13 on the heater board of the printing head 12 in this embodiment. Alternatively, it may be arranged to store the characteristic in the ROM 1702 or RAM 1703. When printing is thus actually carried out, the clock signal 221 is outputted in 16 pulses in-a case where the counter 201 is a four-bit counter, by way of example. As a result, heating pulse width is decided in dependence upon the leading-edge and trailing-edge data stored in the latch circuit 202, as shown in the timing chart of FIG. 24, whereby the heating resistors 901 are heated.

By mounting the printing head 12 constructed as set forth above in the ink-jet printing apparatus of this embodiment and applying printing signals to the printing head 12, it is possible to obtain an ink-jet printing apparatus capable of performing high-speed, high-quality printing.

Figure 25:
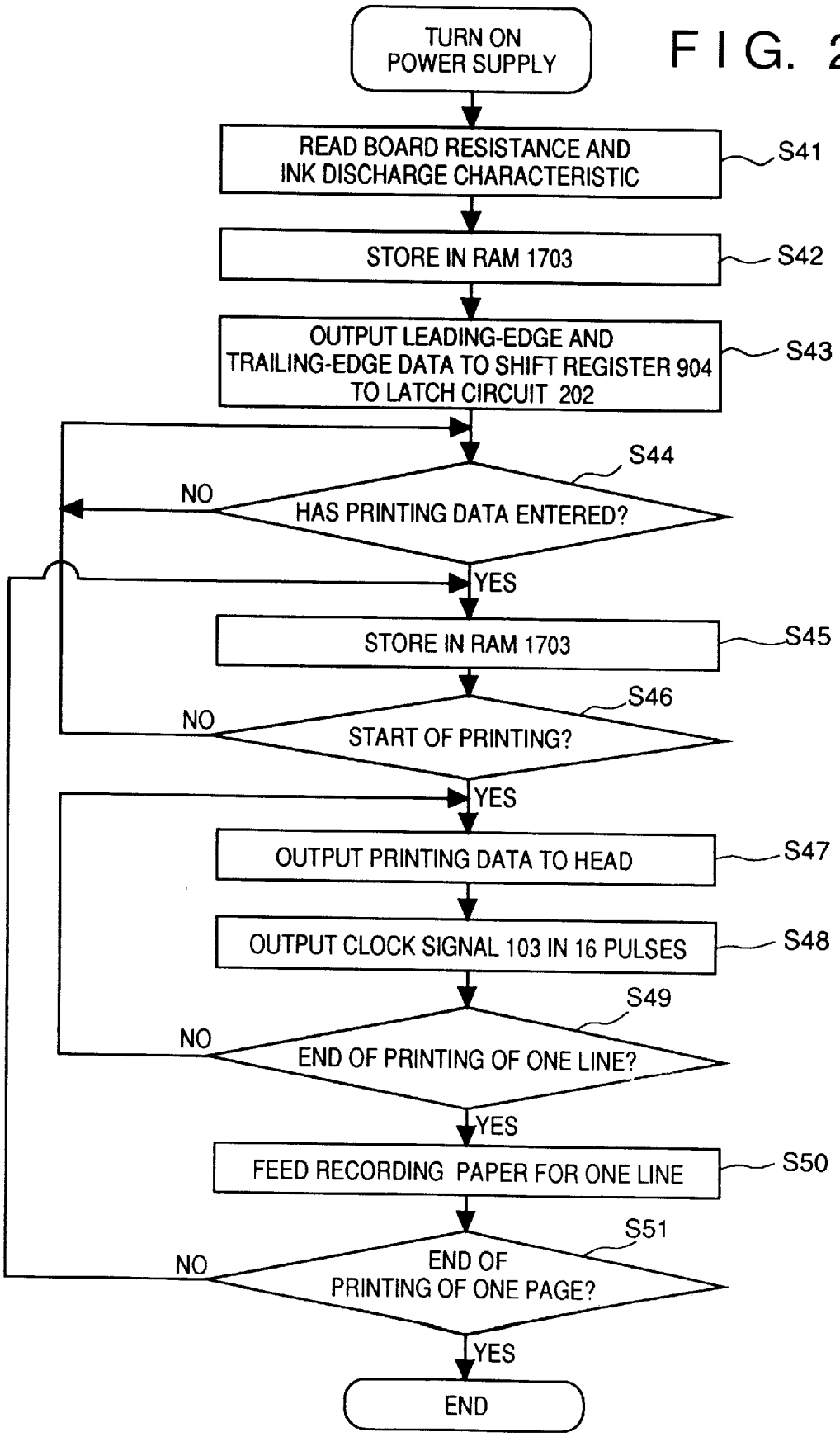
FIG. 25 is a flowchart showing the processing performed by an ink-jet printing apparatus using the printing head of the third embodiment.

FIG. 25 is a flowchart showing printing processing from turn-on of the power supply to the end of printing of one page in the ink-jet printing apparatus of the third embodiment. The control program for executing this processing is stored in the ROM 1702 and is executed by the MPU 1701.

The processing shown in FIG. 25 is started by turning on the power supply of the apparatus. At step S41 in the flowchart, the resistance values of the heating resistors 901 on each heater board 1000*a* of the printing head 12 and the ink discharge-quantity characteristic of each nozzle (discharge port) of the heater board are read. The read values are stored in the RAM 1703 at step S42. The resistance values of the heating resistors 901 are detected by the resistance sensor 914, and the ink discharge-quantity characteristic of each nozzle is stored in, say, the memory 13 provided in the printing head 12. Next, at step S43, the above-mentioned leading-edge and trailing-edge data is decided in conformity with the resistance values of the heating resistors 901 of the heater board 1000*a* and the ink discharge-quantity characteristics, this data is transferred serially to the shift register 904 on each heater board 1000*a* of the printing head 12 and the data is latched in the latch circuit 202 of the heating-pulse generating circuit 300 of each heater board. When the latch circuit 202 is constituted by multiple stages, the latch signal and select signal (these signals enter collectively) are outputted and latched in the latch circuit 202 stage by stage.

Next, at step S44, it is determined whether printing data has entered from an external device (host computer), not shown, via the interface 1700. If printing data has entered, the program proceeds to step S45, at which the received printing data is stored in the RAM 1703. Next, the program proceeds to step S46, at which it is determined whether one line of printing, for example, is capable of starting. If the answer is NO, the program returns to step S44. If the answer is YES, the program proceeds to step S47.

At step S47, printing data to be printed on an initial single row is transferred serially to the shift register 904. Next, one line of printing data is latched in the latch circuit 903 of each heater board 1000*a* and the data is outputted to the AND gate. Next, at step S48, the clock signals (CLK) 221 of 16 pulses according to this embodiment are supplied with the counter 201. As a result, as shown for example in FIG. 24, the pulse widths of the heating pulses are decided in dependence upon the leading-edge and trailing-edge data from the latch circuit 202, whereby the heating resistors 901 on each heater board of the printing head 12 are electrified (heated). Actual printing of an image is thus carried out.

The reception of data from the host computer and the transfer of the next series of printing data to the shift register 904 of each heater board are carried out even during heating processing for actual printing. Further, an arrangement may be adopted in which the heating resistors are electrified in sections at staggered times instead of the arrangement in which all heating resistors 901 are electrified simultaneously at step S48. By virtue of this arrangement, the capacity of the power supply of the apparatus can be reduced. Next, at step S49, it is determined whether the printing of one line has ended. If the printing of one line has not ended, the program returns to step S47 to repeat processing from this step.

When the printing processing for one line ends, the program proceeds from step S49 to step S50, where the conveyance motor 1709 is rotated to convey the recording paper in the sub-scan direction by an amount equivalent to one printed line. This is followed by step S51, at which it is determined the printing of one page has ended. If the answer is NO, then the program returns to step S46, at which it is determined whether reception of the next line of printing data has been completed. When the printing of one page of an image is finished by repeating the above-described operation, printing processing is terminated.

In accordance with the third embodiment, as described above, the width of heating pulses can be changed through a simple arrangement. At the time of actual output of heating pulses (actual printing of an image), the clock signal 221 need only be outputted, as a result of which the burden upon the MPU 1701 can be reduced. In this embodiment, the value of the sensor 914 is detected only at the beginning of the printing processing of one line. However, an arrangement may be adopted in which this is carried out whenever the heating resistors are electrified.

Further, in accordance with the third embodiment, as described above, a heating pulse and a plurality of preheating pulses are supplied separately to each heater board of the ink-jet head, preheating pulses are selected by the latch circuit 102 provided within the heater board to save selection data, and the preheating pulse is combined with a main heating pulse for printing (the AND of the main heating pulse and image data), thereby making it possible to exploit the conventional shift register 904 effectively. As a result, circuit portions for entering the selection data can be deleted to prevent an increase in the space occupied by the circuitry.

Furthermore, any preheating pulse can be selected with ease merely by storing the selection data, which selects one or some of the preheating pulses, in each heater board of the printing head 12. As a result, the amount of ink discharged from each nozzle can be controlled in a simple manner.

Further, printing can be performed while holding applied energy substantially constant even in a printing head constituted by a plurality of heater boards. As a result, it is possible to obtain a high-quality printed image free of uneven density and streaking that accompany a fluctuation in amount of ink discharge.

Further, it is possible to provide a long-life printing head and a printing apparatus which uses this head.

Figure 26:
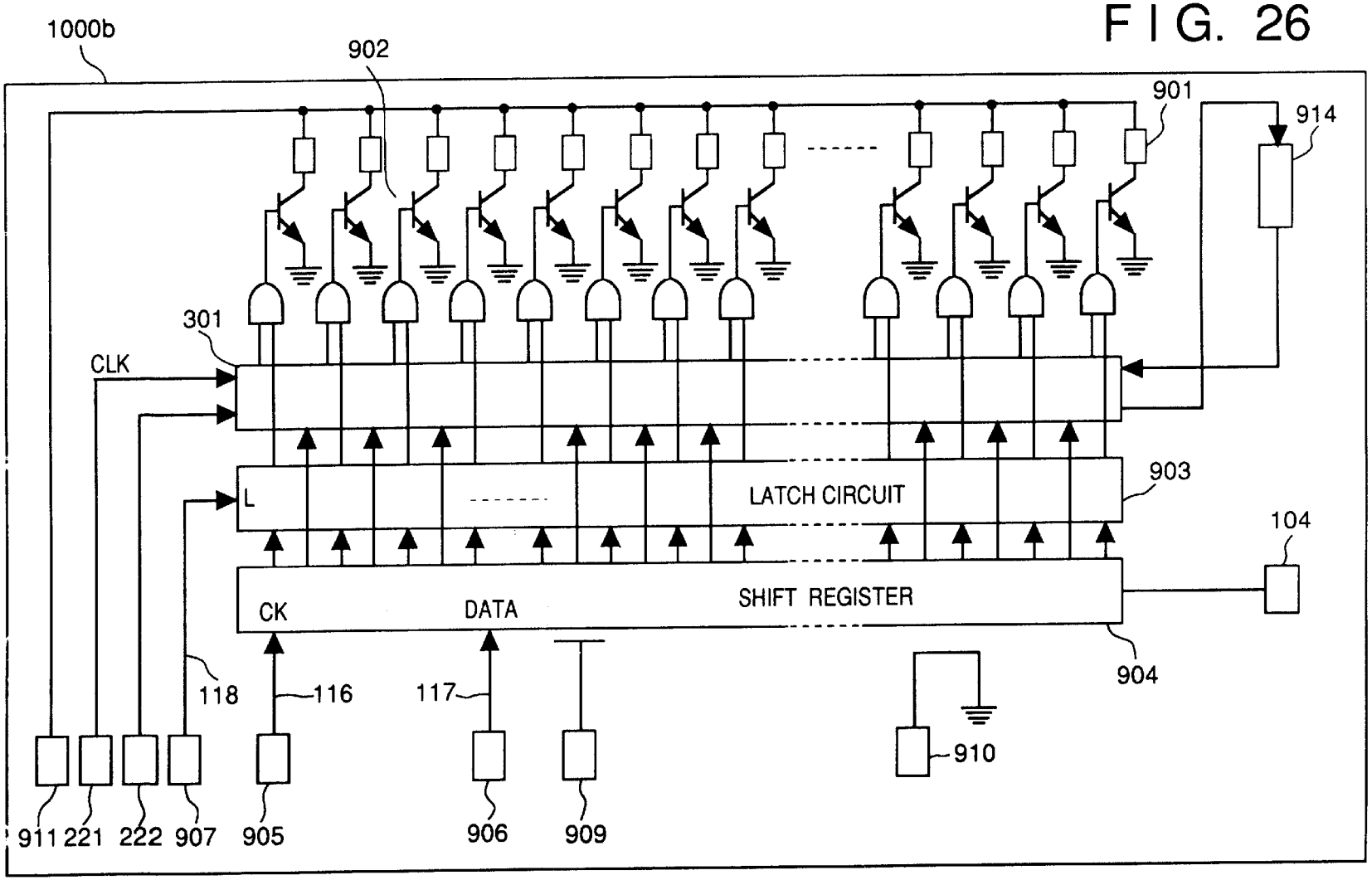
FIG. 26 is a diagram showing the circuit arrangement on a heater board of a printing head according to a fourth embodiment of the invention.

FIG. 26 is a block diagram illustrating the construction of a heater board 1000*b*, one of the heater boards in the printing head 12 according to a fourth embodiment. Components in FIG. 26 identical with those of the foregoing embodiment are designated by like reference numerals and need not be described again.

In the fourth embodiment, the heating-pulse generating circuit 301 obtains the resistance characteristics of the heating resistors 901 using the sensor 914, selects the proper pulse width automatically and drives the heating elements 901.

In FIG. 26, the heating-pulse generating circuit 301 latches leading-edge data and trailing-edge data applied thereto, just as in third embodiment. However, this embodiment differs from the third embodiment in that the heating-pulse generating circuit 301 latches plural types of leading-edge data and trailing-edge data applied thereto, detects the resistance value of the resistance sensor 914 directly connected to the circuit 301 and selects a pulse width (trailing-edge data) conforming to this resistance value. It should be noted that the resistance sensor 914 is formed on the heater board 1000*b* at the same time as the heating resistors 901 and faithfully reflects the resistance characteristics of the heating resistors 901.

Figure 27:
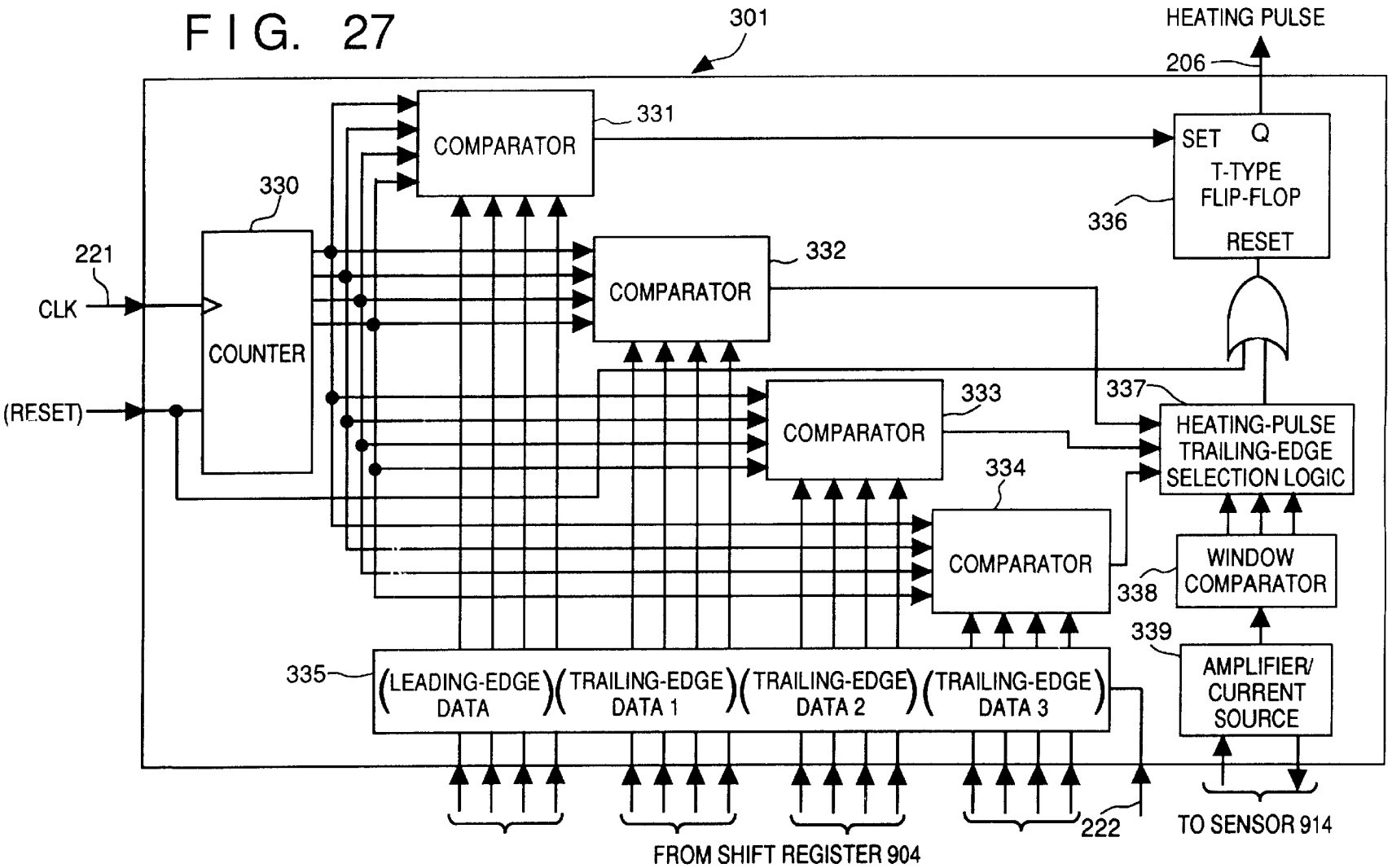
FIG. 27 is a block diagram showing the construction of a selecting circuit according to the fourth embodiment.

FIG. 27 is a block diagram showing part of the construction of the heating-pulse generating circuit 301 of the fourth embodiment. Operation will be described with reference to this drawing.

In FIG. 27, numeral 330 denotes a four-bit counter similar to that of the counter 201, and numerals 331~334 denote comparators similar to the comparator 203 or 204 of the foregoing embodiment. The comparators 331~334 each compare the output value of the counter 330 with the leading-edge data and trailing-edge data latched in the latch circuit 335 and output a high-level signal when agreement is achieved. A flip-flop 336 is similar to the flip-flop 205 and decides the pulse width of the heating pulse signal. A selecting circuit 337 selects one of the outputs of the comparators 332~334, i.e., the trailing-edge timing (i.e., pulse width) of the heating pulses. A window comparator 338 decides the trailing-edge timing, which is to be selected by the selecting circuit 337, in dependence upon the voltage level outputted by an amplifier/current source 339.

In conformity with the resistance value of the resistance sensor 914, the selecting circuit 337 selects any one of trailing-edge timings of a pulse signal based upon plural items of trailing-edge data that have been set. As a result, it is possible to realize the drive of heating resistors 901 at a heating pulse width conforming to the resistance values of the heating resistors 901.

In the fourth embodiment also, as in the foregoing embodiment, the latch circuit 335 is constituted by a plurality of stages, and inputs are made in the form of one-bit data in each stage, thereby making it possible to set a pulse width corresponding to one heating resistor 901.

In the description given above, the sensor 914 is described as being a resistance sensor. However, this may be a temperature sensor such as a thermistor, by way of example. In such case, the temperature of the heater board or the extent to which heat is retained by the heating resistors 901 may be sensed to realize printing control (excitation control) conforming thereto. This makes it possible to obtain a printed image of even higher quality.

With regard to processing executed by the MPU 1701 in this case, the step of reading the value of the sensor 914 at step S41 is no longer necessary. Further, at step S43, plural types of trailing-edge data need only be set in advance, after which processing may be performed just as in the third embodiment.

In accordance with the fourth embodiment, as described above, control by the MPU 1701 is made unnecessary, as a result of which the burden upon the controller can be alleviated. Further, though it is important to provide these sensors and monitor the resistance value or temperature of each heater board, the burden upon the control circuitry by an increase in the number of sensors is alleviated in this case also. This makes real-time processing possible.

In the third embodiment, a great amount of processing is performed by the MPU 1701 to deal with the resistance values or temperature values, which change from moment to moment. In the fourth embodiment, however, there is no increase in the burden upon the MPU 1701 and a change in the temperature of the heater board elements can be dealt with in real time.

Further, since cables and connectors for connection to the outside are unnecessary, the effects of external noise are eliminated and cost of manufacture can be reduced.

In the foregoing description, an example is described in which the board of a printing head is employed in the printing head of an ink-jetting type. However, this does not impose a limitation upon the invention for board can also be applied to that for a thermal head.

The present invention has been described with regard to a printing apparatus of the type having means (e.g., an electrothermal transducer or laser beam) for generating thermal energy as the energy utilized to jet ink, wherein a change in the state of the ink is brought about by this thermal energy. In accordance with this method of printing, high-density, high-definition printing can be achieved.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatus. In the case of the on-demand type, at least one drive signal, which provides a sudden temperature rise that exceeds that for film boiling, is applied, in accordance with printing information, to an electrothermal transducer arranged to correspond to a sheet or fluid passageway holding a fluid (ink). As a result, thermal energy is produced in the electrothermal transducer to bring about film boiling on the thermal working surface of the printing head. Accordingly, air bubbles can be formed in the fluid (ink) in one-to-one correspondence with the drive signals. Owing to growth and contraction of the air bubbles, the fluid (ink) is jetted via the discharge port so as to form at least one droplet. If the drive signal has the form of a pulse, growth and contraction of the air bubbles can be made to take place rapidly and in appropriate fashion. This is preferred since it will be possible to achieve fluid (ink) jetting having excellent response.

Signals described in the specifications of U.S. Pat. Nos. 4,463,359 and 4,345,262 are suitable as drive pulses having this pulse shape. It should be noted that even better recording can be performed by employing the conditions described in the specification of U.S. Pat. No. 4,313,124, which discloses an invention relating to the rate of increase in the temperature of the abovementioned thermal working surface.

In addition to the combination of the discharge port, fluid passageway and electrothermal transducer (in which the fluid passageway is linear or right-angled) disclosed as the construction of the printing head in each of the above-mentioned specifications, the present invention covers also an arrangement using the art described in the specifications of U.S. Pat. Nos. 4,558,333 and 4,459,600, which disclose elements disposed in an area in which the thermal working portion is curved. Further, it is possible to adopt an arrangement based upon Japanese Patent Application Laid-Open No. 59-123670, which discloses a configuration having a common slot for the ink discharge portions of a plurality of electrothermal transducers, or Japanese Patent Application Laid-Open No. 59-138461, which discloses a configuration having openings made to correspond to the ink discharge portions, wherein the openings absorb pressure waves of thermal energy.

As a printing head of the full-line type having a length corresponding to the maximum width of the recording medium capable of being printed on by the printing apparatus, use can be made of an arrangement in which the length is satisfied by a combination of plural printing heads of the kind disclosed in the foregoing specifications, or an arrangement in which printing heads serve as a single integrally formed printing head.

Further, it is possible to use a freely exchangeable tip-type printing head attached to the main body of the apparatus and capable of being electrically connected to the main body of the apparatus and of supplying ink from the main body, or a cartridge-type printing head in which an ink tank is integrally provided on the printing head itself.

The addition of recovery means for the printing head and spare auxiliary means provided as components of the printing apparatus of the invention is desirable since these stabilize the effects of the invention greatly. Specific examples of these means that can be mentioned are capping means for capping the printing head, cleaning means, pressurizing or suction means, and preheating means such as an electrothermal transducer or another heating element or a combination thereof. Implementing a preliminary ink discharge mode for performing jetting separately of printing also is effective in order to perform stabilized printing.

The printing mode of the printing apparatus is not limited merely to a printing mode for a mainstream color only, such as the color black. The printing head can have a unitary construction or a plurality of printing heads can be combined. It is possible to use an apparatus having at least one printing mode for a plurality of different colors or for full-color printing using mixed colors.

Further, ink is described as being the fluid in the embodiment of the invention set forth above. The ink used may be one which solidifies at room temperature or lower, one which softens at room temperature or one which is a liquid at room temperature. Alternatively, in an ink-jet arrangement, generally the ink is temperature-controlled by regulating the temperature of the ink itself within a temperature range of between 30° C. and 70° C. so that the viscosity of the ink will reside in-a region that allows stable jetting of the ink. Therefore, it is permissible to use an ink liquefied when the printing signal is applied.

In order to positively prevent elevated temperature due to thermal energy by using this as the energy for converting the ink from the solid state to the liquid state, or in order to prevent evaporation of the ink, it is permissible to use an ink which solidifies when left standing but which is liquefied by application of heat. In any case, ink which is liquefied for the first time by thermal energy, such as an ink liquefied by application of thermal energy conforming to a printing signal and jetted as a liquid ink, or ink which has already begun to solidify at the moment it reaches the recording medium, can be applied to the present invention. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

As to the form of the printing apparatus of the present invention, the printing apparatus may be provided integrally or separately as an image output terminal of an information processing apparatus such as a computer. Other configurations include a facsimile machine having a transmitting/receiving function, etc.

In accordance with this embodiment, as described above, a heating pulse and a plurality of preheating pulses are supplied separately to the heater boards of the ink-jet printing head, preheating pulses are selected by a latch provided within the heater board to save selection data, and the preheating pulses are mixed with image jetting pulses (the AND of the heating pulse and image data), thereby making it possible to exploit the conventional shift register effectively. As a result, circuit elements for entering the selection data can be deleted to prevent an increase in the space occupied by the circuitry.

Furthermore, any preheating pulse can be selected with ease merely by storing the selection data, which selects the preheating pulses, in the printing head. As a result, the amount of ink discharged from each nozzle can be controlled in a simple manner.

Further, printing can be performed while holding applied energy substantially constant even in a printing head constituted by a plurality of heater boards. As a result, it is possible to obtain a high-quality printed image free of uneven density and streaking that accompany a fluctuation in amount of ink discharge.

Further, it is possible to provide a long-life printing head and a printing apparatus which uses this head.

In the description given above, it is described that the control unit on the side of the ink-jet printing apparatus controls the printing operation of the printing head on the basis of correction data stored in a memory within the printing head. However, an arrangement may be adopted in which such a control unit is provided within the printing head.

Further, the present invention is applicable irrespective of the form of printing head (e.g., regardless of whether the head is of the serial type or full-line type) and of the type of printing head (e.g., ink-jet head, thermal head, LED printing heat, etc.).

It goes without saying that equivalent effects are obtained even if there is a difference in the method of setting the driving power of each of the printing elements of the printing head.

The present invention has been described with regard to a printing apparatus of the type having means (e.g., an electrothermal transducer or laser beam) for generating thermal energy as the energy utilized to jet ink, wherein a change in the state of the ink is brought about by this thermal energy. In accordance with this method of printing, high-density, high-definition printing can be achieved.

The present invention can be applied to a system constituted by a plurality of devices or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for printing an image on a printing medium by electrifying and driving a printing head, wherein said printing head has resistive elements for driving a plurality of printing elements, input terminals each for receiving a different type of pulse signal for driving said resistive elements, memory means for storing inputted selection data for selecting one of the plurality of types of pulse signals entering from said input terminal, and applying means, which is responsive to the selection data stored in said memory means, for selecting one of the different types of pulse signals entering from said input terminals and applying to said resistive elements, said apparatus comprising:

characteristic information storing means for storing printing characteristics of the printing elements of said printing head;

transfer means for deciding the selection data based on the printing characteristics, which have been stored in said characteristic information storing means, and transferring the selection data decided to said printing head;

preliminary electrifying means for outputting the different types of pulse signals to said printing head and for performing preliminary electrification of said printing head; and printing electrifying means for performing printing by applying current to said resistive elements of said printing head in conformity with image information.

2. A printing apparatus for printing an image on a printing medium by electrifying and driving a printing head comprising a plurality of element substrates each having a plurality of printing elements and a circuit for performing printing by applying signals to said printing elements in dependence upon printing data, said printing head including a memory for storing data for correcting printing characteristics of each of said element substrates, each of said element substrates having a plurality of input terminals each receiving a different type of pulse signal for driving printing elements, memory means for storing inputted selection data, each of the selection data selects one of the different types of pulse signals entering from said input terminal, and signal applying means, which is responsive to the selection data stored in said memory means, for selecting one of the different types of pulse signals entering from said input terminal, and applying the selected pulse signal to each of the printing elements, the apparatus comprising:

characteristic information storing means for storing printing characteristics of the printing elements of said printing head;

transfer means for deciding the selection data based on the printing characteristics, which have been stored in said characteristic information storing means, and transferring the selection data to each element substrate of said printing head;

preliminary electrifying means for outputting the plurality of types of pulse signals to said input terminals of said printing head and for performing preliminary electrification of said printing head; and printing electrifying means for performing printing by flowing current through said resistive elements of said printing head in conformity with image information.

3. The apparatus according to claim 2, further comprising detecting means for detecting resistance values of said resistive elements, wherein said printing means decides printing electrification time of said resistive elements in conformity with said resistance values.

4. The apparatus according to claim 2, further comprising temperature detecting means for detecting temperature of said resistive elements, wherein said printing means decides preliminary electrification time of said resistive elements or quiescent time between preliminary electrification and printing electrification.

5. The apparatus according to claim 2, wherein said resistive elements are heat-generating resistors.

6. The apparatus according to claim 2, wherein said printing head is an ink-jet printing head which performs printing by jetting ink.

7. The apparatus according to claim 6, wherein said printing head jets ink by utilizing thermal energy, said printing head having a thermal energy transducer for generating thermal energy applied to the ink.

8. A printing method for printing an image on a printing medium, comprising the steps of:

providing the printing apparatus according to claim 2;

deciding the selection information based on the printing characteristics of said printing head;

transferring the selection information to said printing head and storing it in said storing means;

outputting different types of pulse signals to said printing head and performing preliminary electrification of said printing head; and performing printing by flowing current through said resistive elements of said printing head in conformity with image information.

9. The method according to claim 8, wherein said resistive elements are heat-generating resistors.

10. A printing head having a plurality of printing elements and a circuit for performing printing by applying a signal to said printing elements in dependence upon printing data, said printing head comprising:

a plurality of input terminals each receiving a different type of pulse signal for driving each of the printing elements;

memory means for storing selection data, each of the selection data selecting one of the different types of pulse signals entering from said input terminals with respect to the printing elements;

latch means tor receiving printing data and latching the printing data with respect to each of the printing elements; and signal applying means, which is responsive to the selection data stored in said memory means, for selecting one of the different types of pulse signals entering from said input terminals, and applying the selected pulse signal to each of the printing elements based on the printing data latched in said latch means.

11. The printing head according to claim 10, wherein said memory means includes a latch circuit for latching the selection data applied thereto via a shift register which holds the printing data serially applied thereto.

12. The printing head according to claim 10, wherein said different type of pulse signal is a preheating signal for preheating said printing elements.

13. The printing head according to claim 10, further comprising detecting means for detecting a resistance value of at least one of said printing elements.

14. The printing head according to claim 10, further comprising temperature detecting means for detecting a temperature of at least one of said printing elements.

15. The printing head according to claim 10, wherein said printing head is an ink-jet printing head which performs printing by jetting ink.

16. The printing head according to claim 15, wherein said printing head jets ink by utilizing thermal energy, said printing head having a thermal energy transducer for generating thermal energy applied to the ink.

17. The printing head according to claim 10, wherein said applying means flows a current through said printing elements upon taking a logical sum of each of said pulse signals in dependence upon the selection data.

18. The printing head according to claim 10, wherein the pulse signals are applied to said printing elements based on the pulse signals of a type which satisfy the condition $p \leqq p' \leqq 2^P$, where represents the number of the plurality of pulse signals and p' represents a number of pulses outputted in dependence upon the selection data.

19. A printing apparatus for printing an image on a printing medium by electrifying and driving the printing head according to claim 10, comprising:

characteristic information storing means for storing printing characteristics of the printing elements of said printing head;

transfer means for deciding the selection data based on the printing characteristics, which have been stored in said characteristic information storing means, and transferring the selection data to said printing head;

preliminary electrifying means for outputting the plurality of types of pulse signals to said input terminals of said printing head and for performing preliminary electrification of said printing head; and printing electrifying means for performing printing by flowing current through said printing elements of said printing head in conformity with image information.

20. The apparatus according to claim 19, further comprising detecting means for detecting a resistance value equivalent to a resistance of at least one of said printing elements, wherein said printing electrifying means decides printing electrification time of said printing elements in conformity with said resistance value.

21. The apparatus according to claim 19, further comprising temperature detecting means for detecting temperature of said printing elements, wherein said printing means decides preliminary electrification time of said printing elements or quiescent time between preliminary electrification and printing electrification.

22. The apparatus according to claim 19, wherein said printing elements are heat-generating resistors.

23. The apparatus according to claim 19, wherein said printing head is an ink-jet printing head which performs printing by jetting ink.

24. The apparatus according to claim 23, wherein said printing head jets ink by utilizing thermal energy, said printing head having a thermal energy transducer for generating thermal energy applied to the ink.

25. A printing head according to claim 10, wherein said memory means is provided in correspondence to each said printing element.

26. A printing head according to claim 25, wherein the type of pulse signal is selected for a corresponding said printing element based on the selection data.

27. A printing head according to claim 10, wherein each of said different types of pulse signals has a different pulse-width from other said pulse signals.

28. The printing head according to claim 10, wherein said pulse signals are preheating pulse signals.

29. A printing head comprising:

a plurality of element substrates each having a plurality of printing elements and a circuit for performing printing by applying signals to said printing elements in dependence upon printing data, said printing head including a memory for storing data for correcting printing characteristics of each of said element substrates, each of said element substrates having:

a plurality of input terminals each receiving a different type of pulse signal for driving each of the printing elements;

memory means for storing inputted selection data, each of the selection data selects one of the different types of pulse signals entering from said input terminal with respect to the printing elements;

latch means for receiving printing data and latching the printing data with respect to each of the printing elements; and signal applying means, which is responsive to the selection data stored in said memory means, for selecting one of the different types of pulse signals entering from said input terminal, and applying the selected pulse signal to each of the printing elements based on the printing data latched in said latch means.

30. The printing head according to claim 29, wherein said printing elements are heat-generating resistors.

31. The printing head according to claim 29, wherein said memory means includes a latch circuit for latching the selection data applied thereto via a shift register which holds the printing data serially applied thereto.

32. The printing head according to claim 29, wherein said plurality of pulse signals are preheating signals for preheating said printing elements.

33. The printing head according to claim 29, wherein each of said element substrates further includes detecting means for detecting a resistance value of at least a one of said printing elements.

34. The printing head according to claim 29, wherein each of said element substrates further includes temperature detecting means for detecting a temperature of at least a one of said printing elements.

35. The printing head according to claim 29, wherein said applying means flows a current through said Printing elements upon taking a logical sum of each of said pulse signals in dependence upon the selection data.

36. The printing head according to claim 29, wherein the pulse signals are applied to said printing elements based on the pulse signals of a type which satisfy the condition $p \leqq p' \leqq 2^P$, where p represents a number of the plurality of pulse signals and p' represents a number of pulses outputted in dependence upon the selection data.

37. A printing head according to claim 29, wherein said memory means is provided in correspondence to each said printing element.

38. A printing head according to claim 37, wherein the type of pulse signal is selected for a corresponding said printing element based on the selection data.

39. A printing head according to claim 29, wherein each of said different types of pulse signals has a different pulse-width from other said pulse signals.

40. The printing head according to claim 29, wherein said printing head is an ink-jet printing head which performs printing by jetting ink.

41. The printing head according to claim 40, wherein said printing head jets ink by utilizing thermal energy, said printing head having a thermal energy transducer for generating thermal energy applied to the ink.

* * * * *

UNITED STATES PATENT AND TRADEMARK OFFICE

CERTIFICATE OF CORRECTION

PATENT NO. : 6,116,714
DATED : September 12, 2000
INVENTOR(S) : Yoshiyuki Imanaka et al.

It is certified that error appears in the above-identified patent and that said Letters Patent is hereby corrected as shown below:

Column 1,
Line 32, "head" should read -- head can --;
Line 45, "mentioned-above," should read -- mentioned above, --;
Line 58, "number" should read -- number of --.

Column 4,
Line 49, "is to provide" should be deleted;
Line 53, "is to provide" should be deleted.

Column 5,
Line 29, "trough" should read -- through --.

Column 6,
Line 59, "plurality" should read -- plurality of --.

Column 7,
Line 1, "with" should read -- with a --.

Column 9,
Line 31, "a-liquid" should read -- a liquid --.

Column 10,
Line 14, "latch-circuit" should read -- latch circuit --.

Column 11,
Line 39, "selection-of" should read -- selection of --;
Line 42, "supplies" should read -- supplied --.

Column 13,
Line 19, "An-ink-jet" should read -- An ink-jet --;
Line 37, "starting the" (second occurrence) should be deleted.

Column 14,
Line 2, "a-signal" should read -- a signal --.

Column 15,
Line 6, " ( 1AH:H" should read -- (OAH:H --;
Line 28, "executing-this" should read -- executing this --.

UNITED STATES PATENT AND TRADEMARK OFFICE

CERTIFICATE OF CORRECTION

PATENT NO. : 6,116,714
DATED : September 12, 2000
INVENTOR(S) : Yoshiyuki Imanaka et al.

It is certified that error appears in the above-identified patent and that said Letters Patent is hereby corrected as shown below:

Column 16,
Line 42, "inkjet" should read -- ink-jet --;

Column 17,
Line 9, "from" should be deleted;
Line 52, "ated" should read -- ate --.

Column 18,
Line 17, "in-a" should read -- in a --.

Column 20,
Line 12, "in" should read -- in the --.

Column 21,
Line 22, "for" should read -- for the --;
Line 59, "abovementioned" should read -- above-mentioned --.

Column 22,
Line 51, "in-a" should read -- in a --.

Column 28,
Line 8, "Printing" should read -- printing --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,116,714
DATED : September 12, 2000
INVENTOR(S) : Yoshiyuki Imanaka et al.

It is certified that error appears in the above-identified patent and that said Letters Patent is hereby corrected as shown below:

Column 16,
Line 67, “input” should read -- input in --.

Signed and Sealed this

Thirteenth Day of August, 2002

*Attest:*

*Attesting Officer*

JAMES E. ROGAN
*Director of the United States Patent and Trademark Office*